US008419523B2

(12) United States Patent
Kitamura et al.

(10) Patent No.: US 8,419,523 B2
(45) Date of Patent: Apr. 16, 2013

(54) GAMING MACHINE IN WHICH SYMBOL INVOLVING POSSIBILITY OF WINNING PRIZE IS ILLUMINATED

(75) Inventors: Kenta Kitamura, Koto-Ku (JP); Yoshiaki Yabata, Koto-Ku (JP); Yuki Terada, Koto-Ku (JP); Hiroatsu Ike, Koto-Ku (JP)

(73) Assignees: Universal Entertainment Corporation, Tokyo (JP); Aruze Gaming America, Inc., Las Vegas, NV (US)

( * ) Notice: Subject to any disclaimer, the term of this patent is extended or adjusted under 35 U.S.C. 154(b) by 0 days.

(21) Appl. No.: 13/068,859

(22) Filed: May 24, 2011

(65) Prior Publication Data

US 2012/0302314 A1 Nov. 29, 2012

(51) Int. Cl.
*A63F 9/24* (2006.01)

(52) U.S. Cl.
USPC ..... 463/20; 463/16; 463/17; 463/18; 463/19

(58) Field of Classification Search ..... 463/16, 463/17, 18, 19, 20
See application file for complete search history.

(56) References Cited

U.S. PATENT DOCUMENTS

| | | | | |
|---|---|---|---|---|
| 4,283,709 | A | 8/1981 | Lucero et al. | |
| 5,820,459 | A | 10/1998 | Acres et al. | |
| 6,003,013 | A | 12/1999 | Boushy et al. | |
| 6,695,696 | B1 * | 2/2004 | Kaminkow | 463/16 |
| 7,485,039 | B2 * | 2/2009 | Okada | 463/20 |
| 7,699,696 | B2 * | 4/2010 | Baerlocher et al. | 463/16 |
| 7,892,094 | B2 * | 2/2011 | Tanimura et al. | 463/31 |
| 8,070,586 | B1 * | 12/2011 | D'Avanzo | 463/20 |
| 8,092,305 | B2 * | 1/2012 | Seelig et al. | 463/31 |
| 2002/0002584 | A1 | 1/2002 | Takagi et al. | |

FOREIGN PATENT DOCUMENTS

| | | |
|---|---|---|
| JP | 2006-326336 | 12/2006 |

* cited by examiner

*Primary Examiner* — Pierre Eddy Elisca
*Assistant Examiner* — Shahid Kamal
(74) *Attorney, Agent, or Firm* — Edwards Wildman Palmer LLP

(57) ABSTRACT

A slot machine 10 includes: reels 101-105 each having symbols 501; backlight devices M7 which individually light the symbols 501; a display window 150 which displays the symbols 501; and a motherboard 70 programmed to run a game in which the reels 101-105 are rotated to rearrange the symbols 501, and a prize is awarded according to a combination of the symbols 501. The motherboard 70 (a1) drives and rotating the reels 101-105; (a2) stops the rotation of a predetermined reel; (a3) causes a backlight source M70 of a backlight device M7, which corresponds to a winning-related symbol 501 out of the symbols 501 rearranged, to be in an on-state while causing a backlight source M70 of a backlight device M7 corresponding to a non-winning-related symbol 501 to be in an off-state; and (a4) executes (a3) every time the rotation of at least one of the reels 101-105 is stopped.

2 Claims, 16 Drawing Sheets

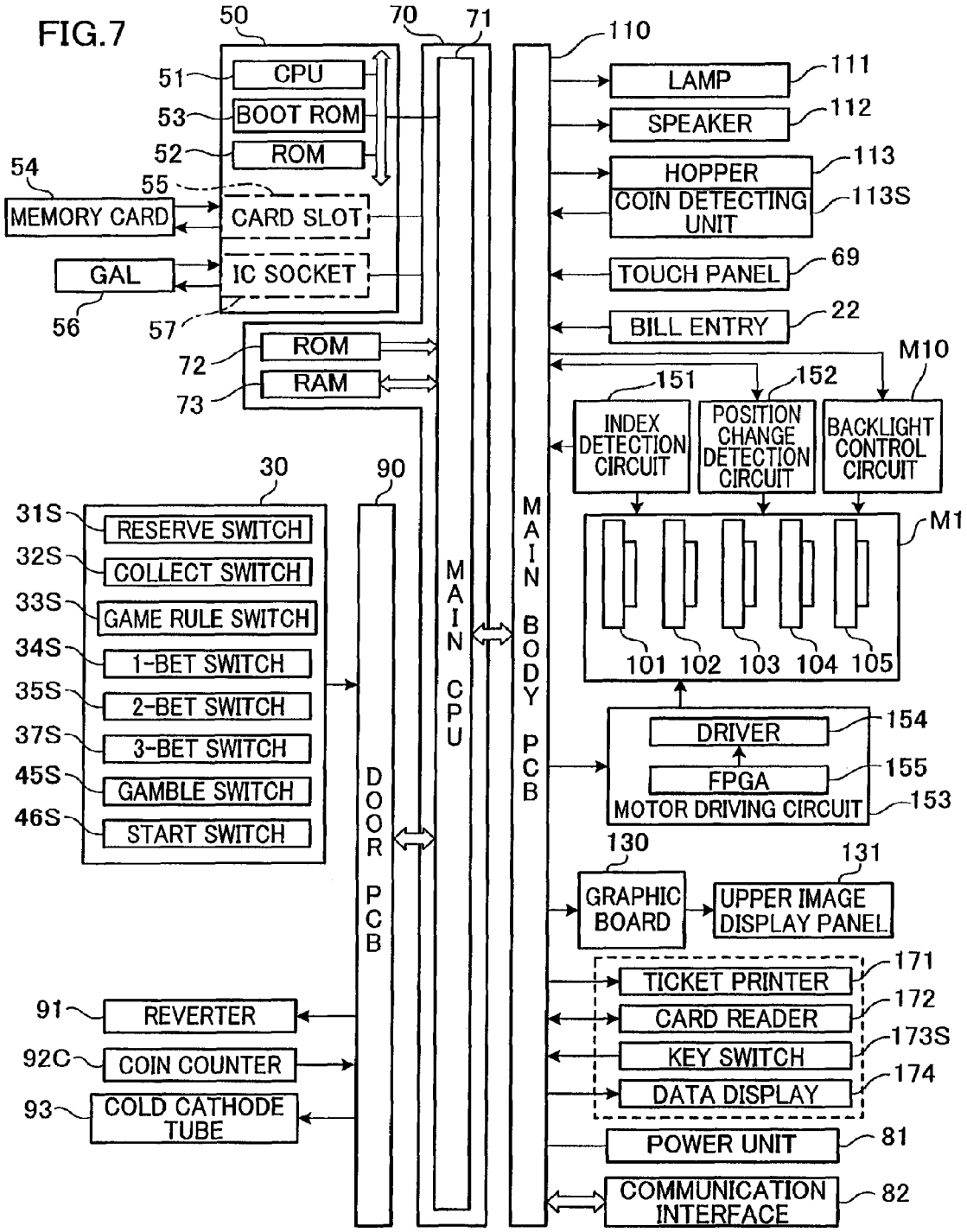
FIG.7
50
70
71
110
51
CPU
53
BOOT ROM
52
ROM
54
55
MEMORY CARD
CARD SLOT
GAL
IC SOCKET
56
57
72
ROM
73
RAM
LAMP
111
SPEAKER
112
HOPPER
113
COIN DETECTING UNIT
113S
TOUCH PANEL
69
BILL ENTRY
22
M10
151
152
INDEX DETECTION CIRCUIT
POSITION CHANGE DETECTION CIRCUIT
BACKLIGHT CONTROL CIRCUIT
30
90
31S
RESERVE SWITCH
32S
COLLECT SWITCH
33S
GAME RULE SWITCH
34S
1-BET SWITCH
35S
2-BET SWITCH
37S
3-BET SWITCH
45S
GAMBLE SWITCH
46S
START SWITCH
MAIN CPU
MAIN BODY PCB
DOOR PCB
M1
101 102 103 104 105
DRIVER
154
FPGA
155
MOTOR DRIVING CIRCUIT
153
130
131
GRAPHIC BOARD
UPPER IMAGE DISPLAY PANEL
171
TICKET PRINTER
172
CARD READER
173S
KEY SWITCH
174
DATA DISPLAY
91
REVERTER
92C
COIN COUNTER
93
COLD CATHODE TUBE
POWER UNIT
81
COMMUNICATION INTERFACE
82

FIG.8A

191

| WINNING SYMBOL COMBINATION | PAYOUT AMOUNT | OCCURRENCE CHANCE IN BASE GAME | OCCURRENCE CHANCE IN FEATURE GAME | TOTAL |
|---|---|---|---|---|
| BAR BAR BAR BAR BAR<br>BAR BAR BAR BAR BAR<br>BAR BAR BAR BAR BAR | 120 | 1/152043 | 1/2098250 | 1/141770 |
| BAR BAR BAR BAR<br>BAR BAR BAR BAR<br>BAR BAR BAR BAR | 60 | 1/21481 | 1/255215 | 1/19814 |
| BAR BAR BAR<br>BAR BAR BAR<br>BAR BAR BAR | 30 | 1/537 | 1/16214 | 1/520 |
| BAR BAR BAR BAR BAR<br>BAR BAR BAR BAR BAR | 90 | 1/20041 | 1/235537 | 1/18469 |
| BAR BAR BAR BAR<br>BAR BAR BAR BAR | 45 | 1/4163 | 1/45223 | 1/3812 |
| BAR BAR BAR<br>BAR BAR BAR | 15 | 1/172 | 1/3928 | 1/165 |
| BAR BAR BAR BAR BAR | 60 | 1/18415 | 1/447518 | 1/17687 |
| BAR BAR BAR BAR | 30 | 1/2185 | 1/36158 | 1/2061 |
| BAR BAR BAR | 12 | 1/101 | 1/2561 | 1/97 |
| ANY BAR ANY BAR ANY BAR ANY BAR ANY BAR | 15 | 1/146 | 1/3145 | 1/139 |
| ANY BAR ANY BAR ANY BAR ANY BAR | 6 | 1/96 | 1/1635 | 1/90 |
| ANY BAR ANY BAR ANY BAR | 3 | 1/8 | 1/250 | 1/7 |
| 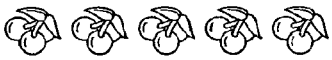 | 60 | 1/1560046480 | 1/1865053251 | 1/849485276 |
| 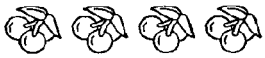 | 30 | 1/4369884 | 1/5890763 | 1/2508804 |
| 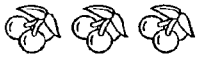 | 15 | 1/31144 | 1/58883 | 1/20370 |
| 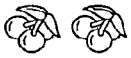 | 6 | 1/454 | 1/1724 | 1/360 |
| 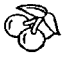 | 3 | 1/14 | 1/108 | 1/12 |

FIG.8B

191

| WINNING SYMBOL COMBINATION | PAYOUT AMOUNT | OCCURRENCE CHANCE IN BASE GAME | OCCURRENCE CHANCE IN FEATURE GAME | TOTAL |
|---|---|---|---|---|
| | 1000 | 1/10415 | 1/6807 | 1/4116 |
| | 300 | 1/1037 | 1/677 | 1/410 |
| | 200 | 1/494 | 1/335 | 1/200 |
| TOTAL | -- | 1/324 | 1/217 | 1/130 |

| FEATURE GAME TRIGGER | PAYOUT | OCCURRENCE CHANCE IN BASE GAME | CHANCE CHERRY SETTING |
|---|---|---|---|
| CHANCE | 3 | 1/70 | ■OCCURS ONLY ON THIRD REEL 103<br>■OCCURRENCE OF CHANCECHERRY TRIGGERS FEATURE GAME IN WHICH OCCURRENCE CHANCE OF IS INCREASED |

FIG.9

192

| | OCCURRENCE CHANCE OF IN FEATURE GAME | OCCURRENCE CHANCE OF IN FEATURE GAME |
|---|---|---|
| 1ST GAME | – | 1/21.7 |
| 2ND GAME | 1/10.4 | 1/18.7 |
| 3RD GAME | 1/6.6 | 1/15.1 |
| 4TH GAME | 1/4.9 | 1/12.8 |
| 5TH GAME | 1/3.8 | 1/11.3 |
| 6TH GAME | 1/3.7 | 1/9.5 |
| 7TH GAME | 1/2.6 | 1/8.7 |
| 8TH GAME | 1/1.5 | 1/3.1 |

GAMING MACHINE IN WHICH SYMBOL INVOLVING POSSIBILITY OF WINNING PRIZE IS ILLUMINATED

BACKGROUND OF THE INVENTION

1. Field of the Invention

The present invention relates to a gaming machine in which a symbol involving possibility of winning prize is illuminated.

2. Description of Related Art

Traditionally, in a gaming machine adopting coins used exclusively for the gaming machine as a game value for a slot machine, a roulette machine, a card game machine, or the like, a player is able to start a predetermined game by inputting one or more coins into the gaming machine. When the player wins the game, a prize is awarded. Further, such a gaming machine typically runs a plurality of types of games to avoid making the game boring. For example, there is a gaming machine in which, when a predetermined condition is met during a first game which is the base game, a second game which is so-called feature game (bonus game, free game or the like) is run subsequent to the first game. Such a traditional gaming machine is disclosed, for example, in the specifications of U.S. Pat. No. 5,820,459, the specification of U.S. Pat. No. 4,283,709, or the specification of U.S. Pat. No. 6,003,013. Further, US 2002002584 (United States Patent Application), discloses a feature game as the second game. In this feature game, the number of free games is randomly determined or a predetermined number of free games are set. Further, for example, the publication of Japanese Unexamined Patent Publication No. 326336/2006 (Tokukai 2006-326336) describes that when a combination of symbols to result in a prize awarding occurs, the backlight provided to the reels of the slot machine is lighted.

However, in a gaming machine that runs the first game and the second game, as in the above mentioned gaming machine, the second game tends to be the same and boring, and the effect provided by the backlight also tends to be boring.

In view of the above problem, an object of the present invention is to provide a gaming machine with an improved entertainment characteristic, in which a symbol involving possibility of winning prize is illuminated by a backlight.

SUMMARY OF THE INVENTION

The present invention is a gaming machine, including: a plurality of reels each having a plurality of symbols on its outer circumference; backlights which individually lights the plurality of symbols; a display window which displays the symbols to the outside; and a controller programmed to run a game in which the plurality of reels are individually driven and rotated to rearrange the symbols, and a prize is awarded according to a combination of the symbols displayed to the outside through the display window, wherein the controller is further programmed to execute the processes of (a1) driving and rotating the plurality of reels;

(a2) stopping the rotation of at least one of the reels;

(a3) causing a backlight, which corresponds to a winning-related symbol out of the symbols rearranged when any of the reels is stopped rotating and displayed to the outside through the display window, to be in an on-state while causing a backlight corresponding to a non-winning-related symbol to be in an off-state, and (a4) executing (a3) every time the rotation of at least one of the reels is stopped.

In the above structure, the reels are stopped rotating successively. Every time at least one of the reels stops rotating, a backlight, which corresponds to a winning-related symbol displayed to the outside through the display window, is turned to or kept in the on-state while a backlight corresponding to a non-winning-related symbol is turned to or kept in the off-state.

Thus, every time any of the reels stops rotating, a symbol likely to result in a prize is turned to or kept in a lighting-state by the backlight. This enables the player to promptly recognize and focus on a symbol likely to result in a prize, and enables the player to enjoy the game, wishing for another one of such symbols to stop.

The above described gaming machine of the present invention may be adapted so that: the controller awards a prize according to a combination of symbols rearranged on a payline; and in (a3), a backlight corresponding to a winning-related symbol on the payline, which symbol is out of the symbols rearranged when stopping the reels and displayed to the outside through the display window, is turned to or kept in the on-state while backlights corresponding to the other symbols are turned to or kept in the off-state.

In the above structure, the reels are stopped rotating successively. Every time at least one of the reels stops rotating, a backlight, which corresponds to a winning-related symbol on a payline displayed to the outside through the display window, is turned to or kept in the on-state while a backlight corresponding to a non-winning-related symbol is turned to or kept in the off-state.

Thus, every time any of the reels stops rotating, only a symbol likely to result in a prize, which is on the payline is turned to or kept in a lighting-state by the backlight. This enables the player to promptly recognize and focus on a symbol likely to result in a prize, and enables the player to enjoy the game, wishing for another winning-related symbol to stop.

The above described gaming machine of the present invention may be adapted so that: in (a3), the controller causes the backlight of the winning-related symbol to be in a blinking-state.

With the above structure, it is possible to cause only the backlight which corresponds to a winning-related symbol to be in the blinking-state. Therefore, the player is able to more promptly recognize and focus on only the symbol likely to result in a prize.

Further, the present invention is a gaming machine, including: a plurality of reels each having a plurality of symbols on its outer circumference; a display window which displays the symbols to the outside; an effect image device; and a controller programmed to run a game in which the plurality of reels are individually driven and rotated to rearrange the symbols, and a prize or a feature game is awarded according to a combination of the symbols displayed to the outside through the display window, wherein the controller is further programmed to execute the processes of (b1) displaying on the effect image device an effect video to notify that a feature game will be run, when a combination of symbols causing awarding of a feature game is formed by symbols rearranged and displayed to the outside through the display window after the reels are stopped, and (b2) rotating the reels for a predetermined period after (b1), and (b3) running the feature game after (b2).

With the structure, an effect video to notify that a feature game will be run is displayed on the effect image device, when a combination of symbols causing awarding of a feature game is formed by symbols rearranged and displayed to the outside through the display window after the reels are stopped. After that, the reels are rotated for a predetermined period, and the feature game is run thereafter. That is, an effect of rotating the reels for a predetermined period is inserted between the effect video to notify that the feature game will be run and actual running of the feature game.

This provides mentally advantageous effect by providing an extra time for the player to calm down after being excited by the awarding of the feature game. Further, this rotation of the reels lasting a predetermined period enables the player to calm down and induces the player to mentally prepare for the feature game.

Further, the gaming machine of the present invention may further include a backlight which lights the plurality of symbols aligned on the respective outer circumferences of the reels, so that the controller causes the backlight to light the plurality of symbols while rotating the reels for a predetermined period in (b2).

In the structure, the plurality of symbols are turned to or kept in a lighting-state by the backlight, while rotating the reels for a predetermined period. This causes the player's expectation for the feature game.

BRIEF DESCRIPTION OF THE DRAWINGS

FIG. 7 is a block diagram showing an internal structure of the slot machine of the embodiment, according to the present invention.

FIG. 8A is a diagram showing a symbol combination table of the slot machine of the embodiment, according to the present invention.

FIG. 8B is a diagram showing a symbol combination table of the slot machine of the embodiment, according to the present invention.

FIG. 9 is a diagram showing an occurrence chance changing table in the slot machine of the embodiment, according to the present invention.

DESCRIPTION OF THE PREFERRED EMBODIMENTS

Figure 1:
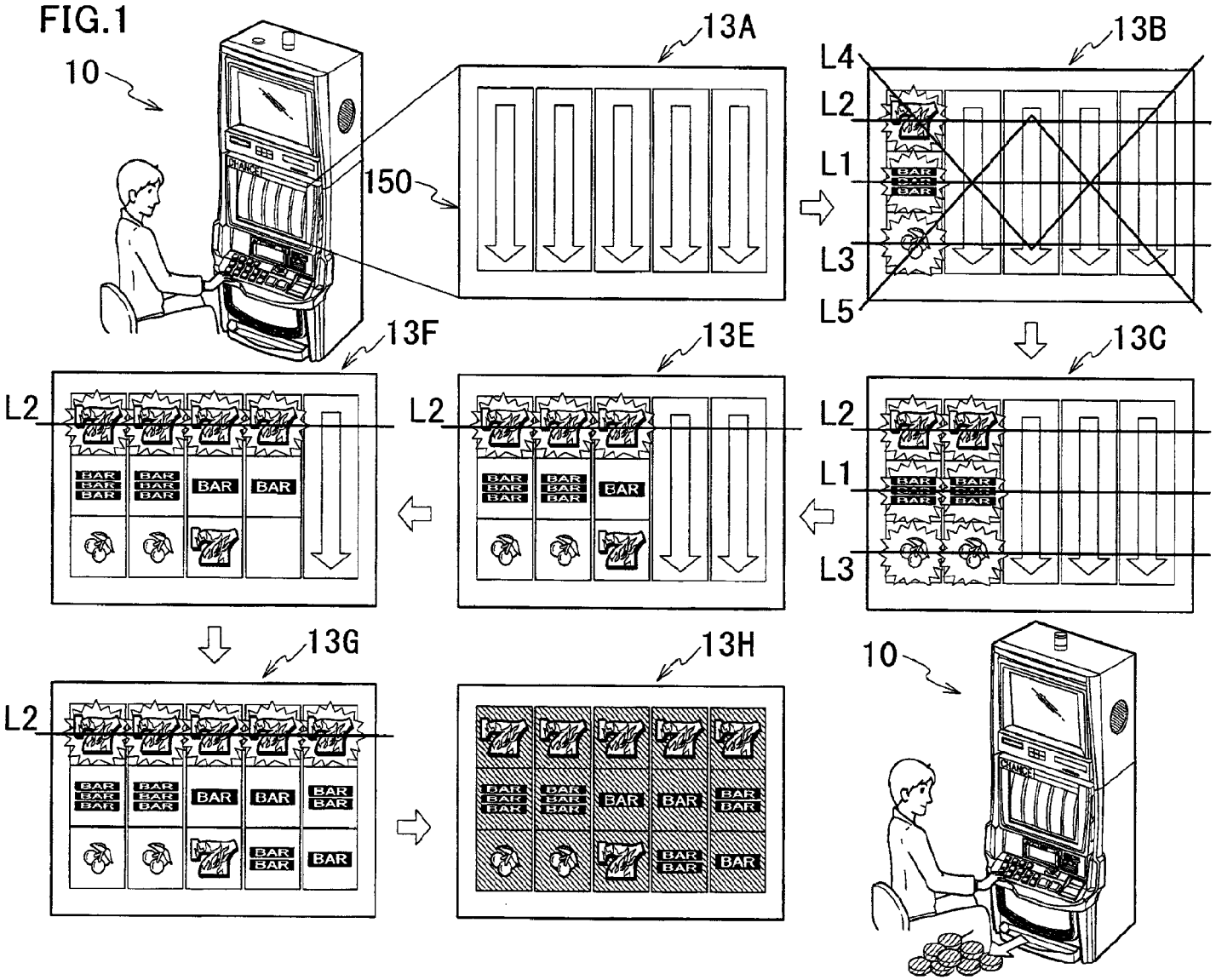
FIG. 1 is a representative diagram showing an effect mode of a slot machine of an embodiment, according to the present invention.

The following describes an embodiment of the present invention, with reference to the drawings.

A slot machine 10 of the present invention includes: a plurality of reels 101, 102, 103, 104, 105 each having a plurality of symbols 501 on its outer circumference; backlight devices M7 which individually light the plurality of symbols 501; a display window 150 which displays the symbols 501 to the outside; and a motherboard programmed to run a game in which the plurality of reels 101, 102, 103, 104, 105 are individually driven and rotated to rearrange the symbols 501, and a prize is awarded according to a combination of the symbols 501 displayed to the outside through the display window 150, wherein the motherboard 70 is further programmed to execute the processes of:

(a1) driving and rotating the plurality of reels 101, 102, 103, 104, 105;

(a2) stopping the rotation of a predetermined reel;

(a3) causing a backlight source M70 of a backlight device M7, which corresponds to a winning-related symbol 501 out of the symbols 501 rearranged when any of the reels is stopped rotating and displayed to the outside through the display window 150, to be in an on-state while causing a backlight source M70 of a backlight device M7 corresponding to a non-winning-related symbol 501 to be in an off-state; and (a4) executing (a3) very time the rotation of at least one of the reels 101, 102, 103, 104, 105 is stopped.

For example, the main CPU 71 determines whether or not a symbol 501 stopped on any of the paylines L1, L2, L3, L4, and L5 is a winning-related symbol (a symbol structuring a winning combination), as shown in the display window screen 13B, the display window screen 13C, the display window screen 13E, the display window screen 13F, and the display window screen 13G of FIG. 1. The details are provided hereinafter. When the main CPU 71 determines that a symbol 501 stopped on any of the paylines L1, L2, L3, L4, and L5 is a winning-related symbol, the main CPU 71 causes the backlight source M70 of the backlight device M7, which corresponds to a winning-related symbol, to be in the on-state. When the main CPU determines that a symbol 501 stopped on any of the paylines L1, L2, L3, L4, and L5 is a non-winning-related symbol (a symbol not structuring a winning combination), the main CPU 71 causes the backlight sources M70 of the backlight devices M7, which corresponds to a non-winning-related symbol, to be in the off state.

In the above structure, the reels 101, 102, 103, 104, 105 are stopped rotating successively. Each time one or more reels stop rotating, a backlight source M70 of the backlight device M7, which corresponds to a winning-related symbol 501 displayed to the outside through the display window 150, is turned to or kept in the on-state and a backlight source M70 of the backlight device M7 corresponding to a non-winning-related symbol 501, is turned to or kept in the off-state.

Thus, every time any of the reels 101, 102, 103, 104, 105 stops rotating, only a symbol 501 likely to result in a prize is turned to or kept in a lighting-state by the backlight source M70 of the backlight device M7. This enables the player to promptly recognize and focus on a symbol 501 likely to result in a prize, and enables the player to enjoy the game, wishing for another one of such a symbol 501 to stop.

(Explanation of Function Flow Diagram)

Figure 2:
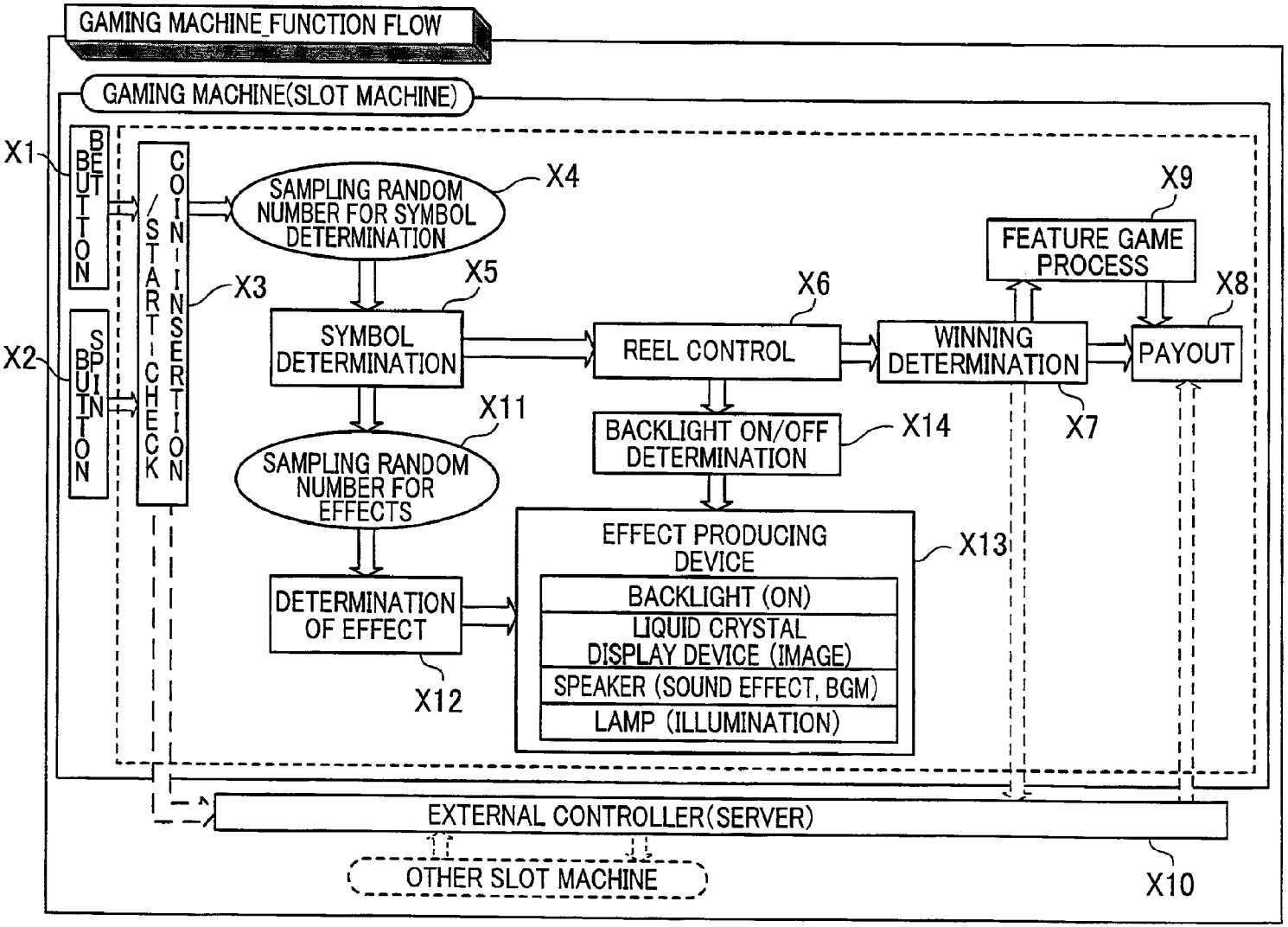
FIG. 2 is a diagram showing a function flow of the gaming machine of the embodiment, according to the present invention.

The following describes basic functions of the gaming machine of the present invention, with reference to FIG. 2.

(Coin-Input/Start-Checking)

First, the gaming machine checks whether or not a BET button X1 has been pressed by a player, and subsequently checks whether or not a start button X2 has been pressed by the player (X3).

(Symbol Determination)

Next, when the start button X2 is pressed by the player, the gaming machine samples a random number for symbol determination (X4), and determines, for each of the plurality of reels, which symbol will be displayed when the rotation of the reels are stopped (X5).

(Reel Control)

Next, the gaming machine starts rotating the reels and then stops the rotation so that the determined symbols are displayed to the player (X6).

(Winning Determination)

When the reels are stopped rotating, the gaming machine determines whether or not a combination of symbols displayed to the player is a combination related to winning (X7).

(Payout)

When the combination of symbols displayed to the player is a combination related to winning, the gaming machine awards a prize (benefit) according to the combination to the player (X8). For example, when a combination of symbols related to a payout of coins has been displayed, the gaming machine pays out coins of the number corresponding to the combination of symbols to the player.

Further, in the gaming machine, the feature game process (X9) is started when the feature game trigger is met in the winning determination of X7. The coins having won in this feature game are also paid out (X8).

In each game, the gaming machine calculates the amount (accumulation amount) to be accumulated to the amount of jackpot and transmits it to an external controller X10. The external controller accumulates to the amount of jackpot the accumulation amount transmitted from the respective gaming machines.

(Effect Determination)

The gaming machine provides various effects by lighting up the symbols provided to the reels with the backlight, displaying an image on the liquid crystal display device, illumination using the lamp, and/or outputting a sound from the speaker (X13). The gaming machine extracts a random value for effect (X11) and determines contents of the effects based on the symbols and the like determined by lottery (X12). Every time the rotation of a reel is stopped, the gaming machine determines whether or not a combination of symbols displayed to the player is a winning-related symbol (backlight on/off determination X14). When the gaming machine determines that any of the symbols stopped is a winning-related symbol, the gaming machine causes the backlight corresponding to the winning-related symbol to be in the on-state (X13). Next, when the gaming machine determines that any of the symbols stopped is a non-winning-related symbol, the gaming machine causes the backlight of the non-winning-related symbols to be in the off-state (X13).

(Entire Gaming System)

The basic functions of the gaming machine have been described above. Next, the following describes a gaming system including a slot machine 10 to which the gaming machine of the present invention is applied.

The gaming system includes a plurality of slot machines 10 and an external controller connected to the slot machines 10 via a communication line (not-shown).

The external controller controls the plurality of slot machines 10. For example, the external controller is a hall server installed in a gaming facility having the slot machines 10. Each of the slot machines 10 has a unique identification number, and the external controller identifies which one of the slot machines 10 transmitted data, by referring to the identification number. Further, when transmitting data from the external controller to any of the slot machines 10, the identification number is used for designating the transmission destination.

It is to be noted that the gaming system may be constructed within a single gaming facility where various games can be performed, such as a casino, or may be constructed among a plurality of gaming facilities. Further, when the gaming system is constructed in a single gaming facility, the gaming system may be constructed in each floor or section of the gaming facility. The communication line may be a wired or wireless line, and can adopt a dedicated line, an exchange line or the like.

(Overall Structure of Slot Machine 10)

Figure 3:
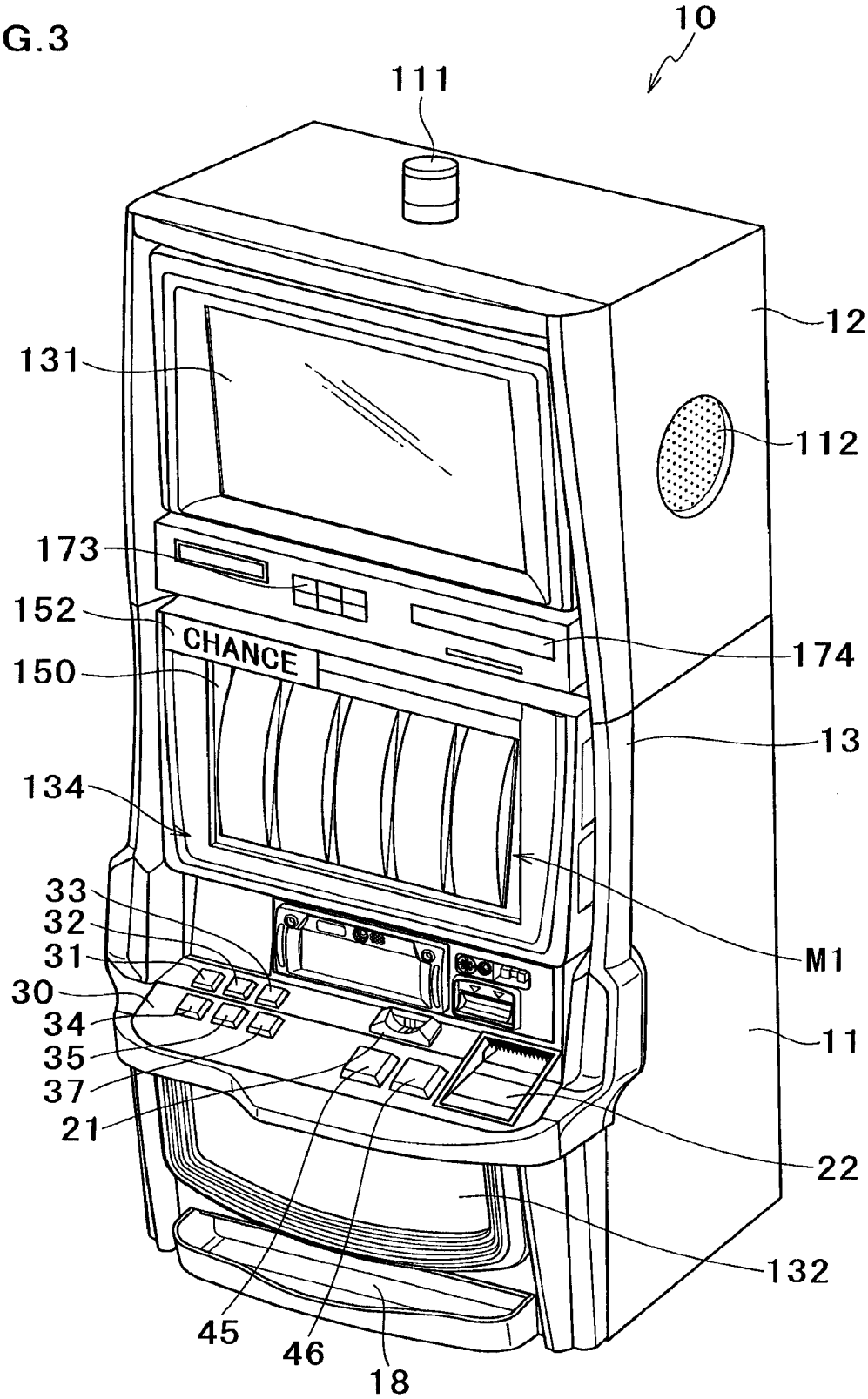
FIG. 3 is a diagram showing an entire structure of the slot machine of the embodiment, according to the present invention.
Figure 4:
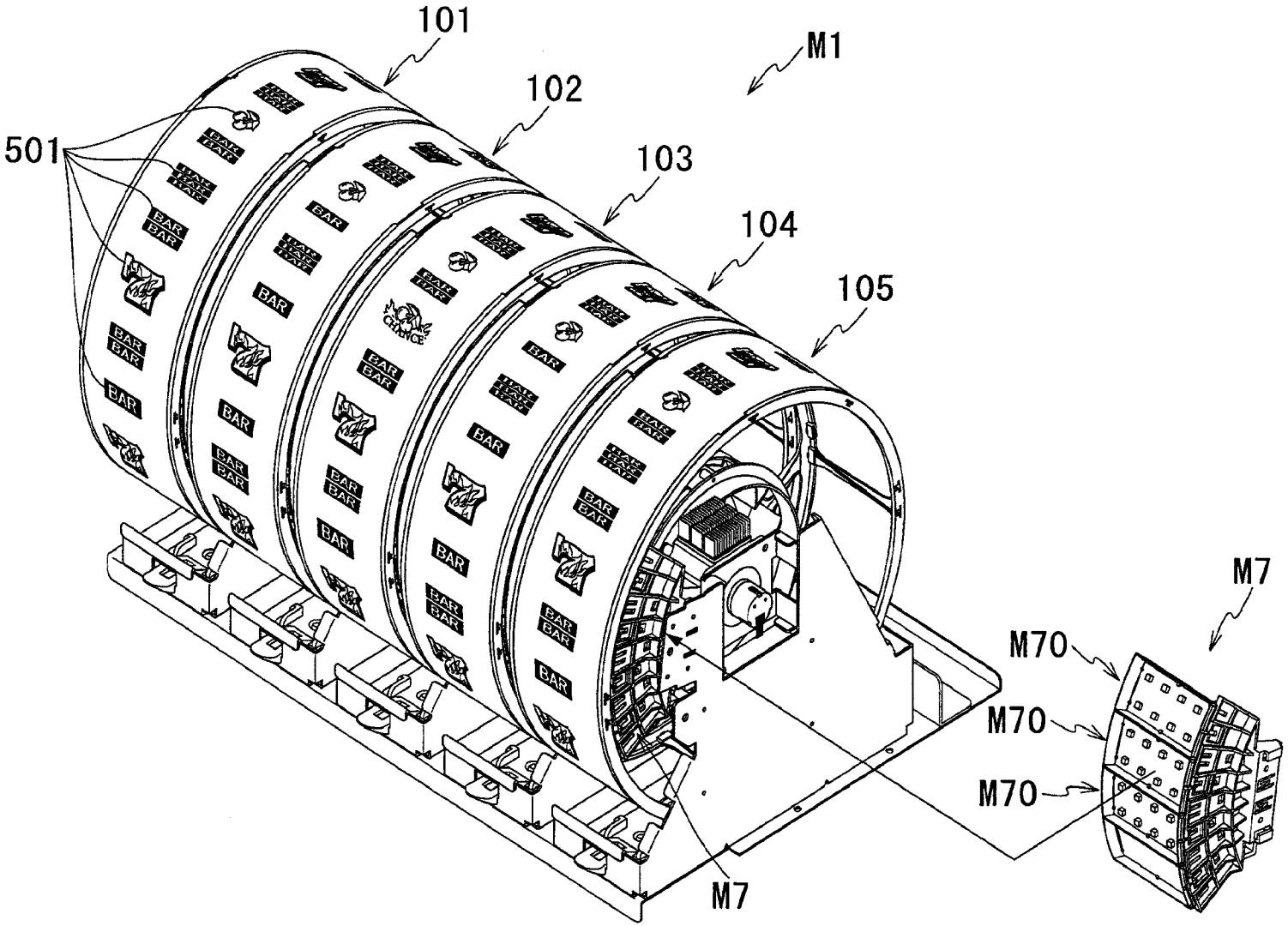
FIG. 4 is a perspective view showing a reel device and a backlight device of the embodiment, according to the present invention.

Next, with reference to FIG. 3 and FIG. 4, the following describes an overall structure of the slot machine 10.

A coin, a bill, or electrically valuable information corresponding to these is used as a game medium in the slot machine 10. Further, in the present embodiment, a later-described ticket with a barcode is also used. It is to be noted that the game medium is not limited to these, and for example a medal, a token, electronic money or the like can be adopted.

Each slot machine 10 includes a cabinet 11, a top box 12 provided above the cabinet 11, a main door 13 provided to the front surface of the cabinet 11.

Figure 5:
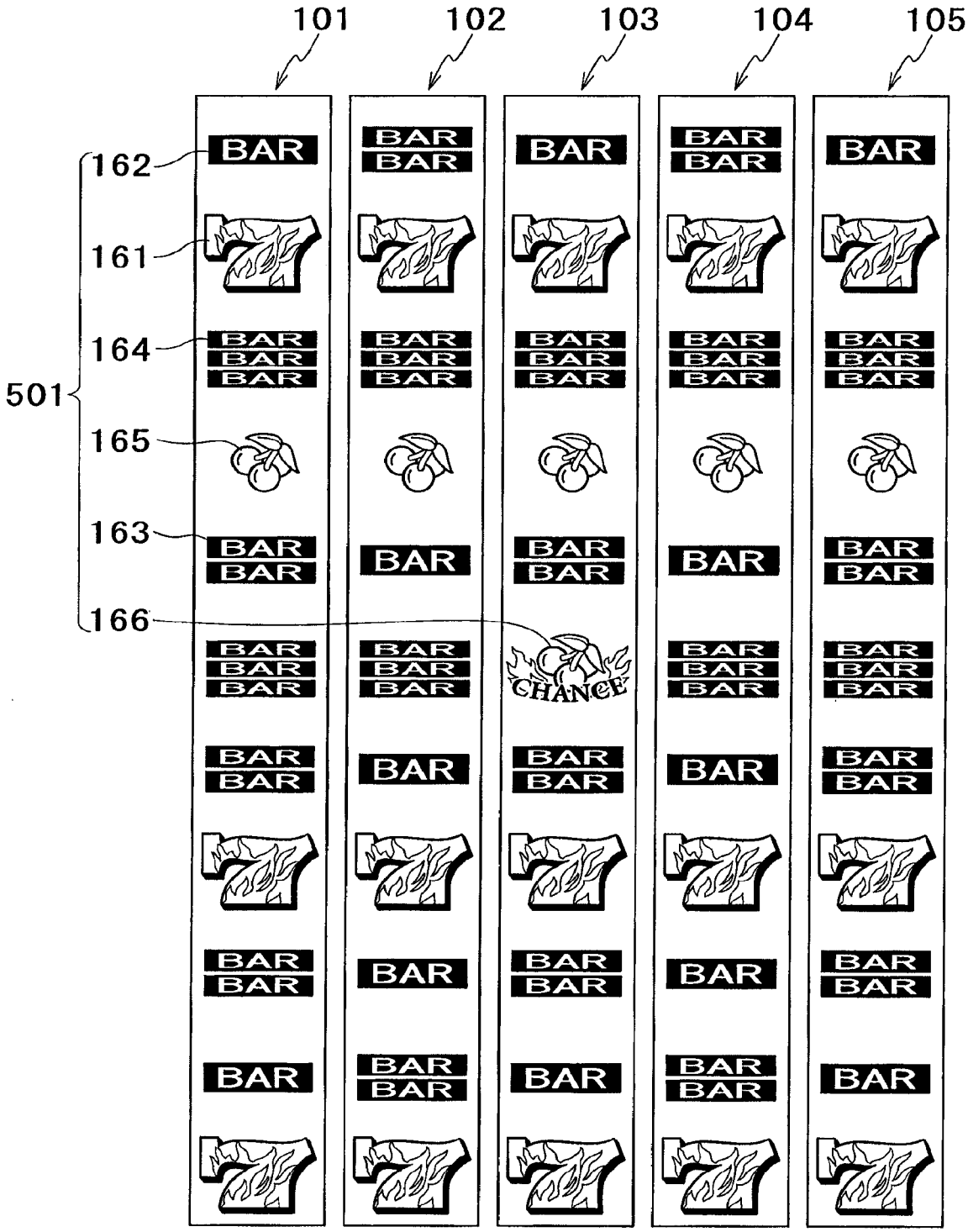
FIG. 5 is a diagram showing a sequence of the symbols drawn on an outer circumference of the reel in the slot machine of the embodiment, according to the present invention.

The main door 13 has a reel device M1 having five reels 101, 102, 103, 104, 105 shown in FIG. 4. On the front surface of the reel device M1 is provided a reel cover 134. Note that the reel cover 134 has a transparent liquid crystal panel or a transparent panel. Further, the reel cover 134 may have a touch panel. The reel cover 134 has at its center a display window 150. With the display window 150, fifteen symbols 501 arranged in five columns and three rows are visible from outside. On the outer circumference of each of the reels 101, 102, 103, 104, 105, there are eleven symbols as shown in FIG. 5. These eleven symbols are successively arranged in a rotation direction of the reels 101, 102, 103, 104, 105 thus forming a symbol column. Further, the on the upper left of the display window 150 is an electroluminescent display 152 capable of performing electroluminescent displaying of text reading "CHANCE".

As shown in FIG. 3 and FIG. 4, the reel device M1 rearranges symbols 501 by rotating the reels 101, 102, 103, 104, 105 each having symbols 501 arranged on its outer circumference. Note that in the following description, the reels are referred to as first reel 101, second reel 102, third reel 103, fourth reel 104, and fifth reel 105, in this order from the left side, respectively.

As shown in FIG. 4, each of the reels 101, 102, 103, 104, 105 with the above described structure has a backlight device M7 on its inner circumference side. The backlight device M7 has three backlight sources M70 arranged in up/down directions. The backlight sources M70 are capable of emitting light in a direction from the inner circumference of the corresponding one of the reels 101, 102, 103, 104, 105 to the outer circumference of the reel, and the light having passed the outer circumference of the reel is visible from outside through the display window 150.

That is, as shown in FIG. 4, the five backlight devices M7 provided on the inner circumferences of the reels 101, 102, 103, 104, 105, respectively are capable of individually emitting light from a total of 15 backlight sources M70 to light up fifteen symbols 501 stopped and displayed in the display window 150.

Each of the backlight sources M70 is capable of adjusting the amount of light emission to several levels, and the backlight device M7 is capable of individually adjusting the level of light emission from the backlight sources M70, thus enabling wider variety of illumination effects.

Figure 6:
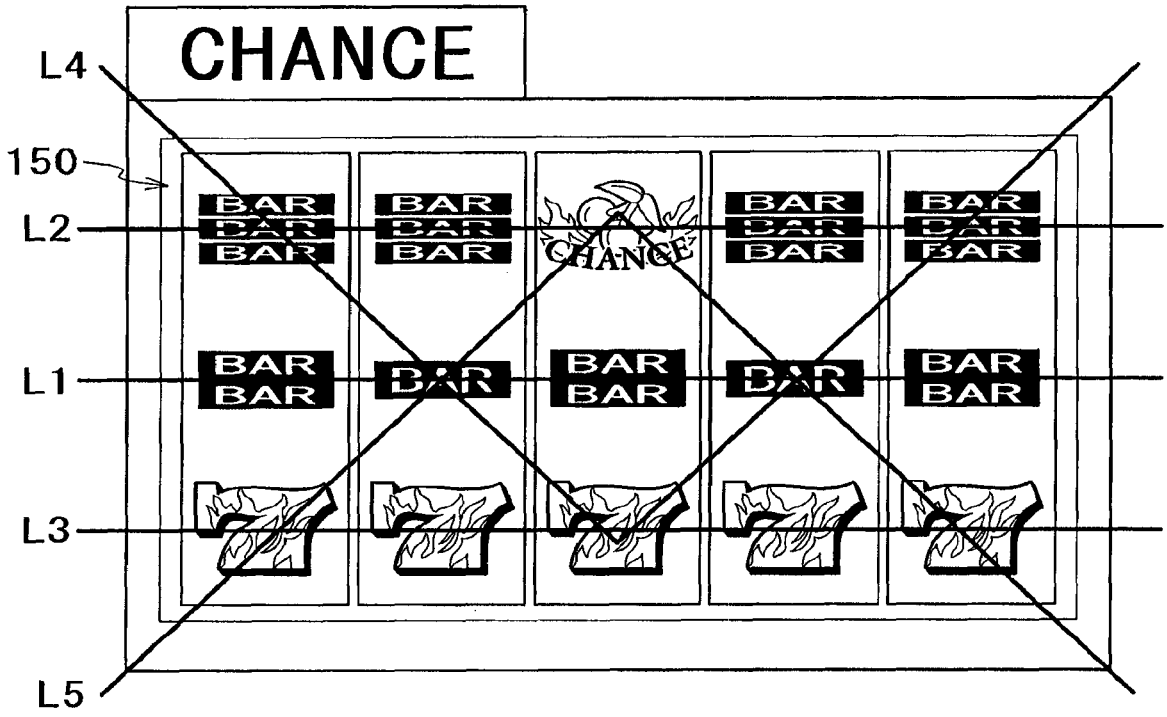
FIG. 6 is a diagram explaining paylines of the slot machine of the embodiment, according to the present invention.

There are five paylines L1, L2, L3, L4, L5 which extend from the left end to the right end of the display window 150, as shown in FIG. 6. The line passing through the middle stage of the display window 150 is a payline L1 which is used for determining whether or not a winning is met. Similarly, the line passing through the upper stage of the display window 150 is a payline L2, and the line passing through the lower stage of the display window 150 is a payline L3. Further, the V-shape line passing through the upper, middle, and lower stages is a payline L4, and the counter V-shape line is a payline L5.

Note that, in the present embodiment, the paylines L1, L2, L3, L4, L5 are all activated irrespective of the amount bet, in response to placing of a bet. Various types of winnings can be resulted based on combinations of the symbols 501 arranged on the activated paylines L1, L2, L3, L4, L5 (see symbol combination table 191 of FIG. 8A and FIG. 8B).

The present embodiment deals with cases where the slot machine 10 adopts a reel device M1 of mechanical reels. However, the slot machine 10 of the present invention may adopt a video reel system which displays a pseudo reel in combination with the mechanical reels. Further, the reel cover 134 may have a touch panel. In such a case, the player is able to enter various instructions by operating the touch panel. From the touch panel, an input signal is transmitted to the main CPU 71.

Below the reel device M1 is arranged a control panel 30. The control panel 30 includes: a reserve button 31, a collect button 32, and a game rule button 33 arranged in the left side area of the upper stage; a 1-bet button 34, a 2-bet button 35, a 3-bet button 37 which are arranged in the left side area of the lower stage; a coin entry 21 and a bill entry 22 for accepting coins and bills into the cabinet 11, respectively, which are arranged in the right side area of the upper stage; and a gamble button 45 and a start button 46 which are arranged in the right side area of the lower stage.

The reserve button 31 is an operation button to be used when temporarily leaving the seat, or when asking a staff member of the gaming facility for an exchange. The collect button 32 is an operation button used for outputting the coins kept inside the slot machine 10 to the coin tray 18. The game rule button 33 is a button pressed when the player is uncertain of how to operate the game. When the game rule button 33 is pressed, various help information is displayed on a later-mentioned upper image display panel 131.

The 1-bet button 34 is a button which bets the player-owned credit one by one on the five active paylines L1, L2, L3, L4, L5. The 2-bet button 35 is a button for starting a game with 2 bets on the five active paylines L1, L2, L3, L4, L5. Further, the 3-bet button 37 is a button for starting a game with 3 bets on the five active paylines L1, L2, L3, L4, L5. Thus, the amount of bet on the five active paylines L1, L2, L3, L4, L5 is determined by pressing of the 1-bet button 34, the 2-bet button 35, or the 3-bet button 37.

The gamble button 45 is an operation button for causing shifting to a gamble game after an end of a feature game or the like. The gamble game here means a game run by using credit the player has won.

The start button 46 is a button for starting rotation of the reels 101, 102, 103, 104, 105. This start button 46 also functions as a button for starting a feature game or adding the payout won in the feature game to the credit. The coin entry 21 is for accepting coins into the cabinet 11. The bill entry 22 validates a bill, and accepts a valid bill into the cabinet 11.

As shown in FIG. 3, the lower front surface of the main door 13, i.e., the lower portion of the control panel 30, has a coin outlet 18 for outputting coins, and a belly glass 132 on which a character of the slot machine 10 or the like is drawn.

An upper image display panel 131 is provided at the front surface of the top box 12. The upper image display panel 131 includes a liquid crystal panel, and forms the display. The upper image display panel 131 displays images related to effects and images showing introduction of the game contents and explanation of the game rules. Further, the top box 12 is provided with a speaker 112 and a lamp 111. The slot machine 10 produces effects by displaying images, outputting sounds, and outputting the light.

A data display 174, and a keypad 173 are provided on the lower side of the upper image display panel 131. The data display 174 includes a fluorescent display, LEDs and the like, and displays the data read out from an IC card inserted or the data inputted by the player via the keypad 173, for example. The keypad 173 is for inputting data.

(Symbol Arrays on Reels)

Next, the following describes the structure of symbol columns drawn on the outer circumference of each of the reels 101, 102, 103, 104, 105 of the slot machine 10, with reference to FIG. 5.

As shown in FIG. 5, each of the reels 101, 102, 103, 104, 105 has on its outer circumference a symbol column having eleven symbols 501. The symbol column is structured by a combination of a "7" symbol 161, a "SINGLE BAR" symbol 162, a "DOUBLE BAR" symbol 163, a "TRIPLE BAR" symbol 164, a "CHERRY" symbol 165, a "CHANCE CHERRY" symbol 166. Note that "CHANCE CHERRY" symbol 166 is provided only to the outer circumference of the third reel 103.

(Structures of Circuits Provided to Slot Machine 10)

Next, with reference to FIG. 7, a configuration of a circuit included in the slot machine 10 is described.

A gaming board 50 is provided with: a CPU 51, a ROM 52, and a boot ROM 53, which are mutually connected by an internal bus; a card slot 55 corresponding to a memory card 54; and an IC socket 57 corresponding to a GAL (Generic Array Logic) 56.

The memory card 54 includes an involatile memory, and stores a game program and a gaming system program. The game program includes a program related to game progression, a lottery program, a symbol combination table 191, an occurrence chance changing table 192, and a program for producing effects by images and sounds.

Further, the card slot 55 is configured so that the memory card 54 can be inserted thereinto and removed therefrom, and is connected to a motherboard 70 by an IDE bus.

The GAL 56 is a type of PLD (Programmable Logic Device) having a fixed OR array structure. The GAL 56 is provided with a plurality of input ports and output ports, and predetermined input into the input port causes output of the corresponding data from the output port.

Further, the IC socket 57 is configured so that the GAL 56 can be inserted thereinto and removed therefrom, and is connected to the motherboard 70 by a PCI bus. The contents and settings of the game to be played on the slot machine 10 can be changed by replacing the memory card 54 with another memory card 54 having another program written therein or by rewriting the program written into the memory card 54 as another program.

The CPU 51, the ROM 52 and the boot ROM 53 mutually connected by the internal bus are connected to the motherboard 70 by a PCI bus. The PCI bus enables a signal transmission between the motherboard 70 and the gaming board 50, and power supply from the motherboard 70 to the gaming board 50.

The ROM 52 stores an authentication program. The boot ROM 53 stores a pre-authentication program, a program (boot code) to be used by the CPU 51 for activating the pre-authentication program, and the like.

The authentication program is a program (falsification check program) for authenticating the game program and the gaming system program. The pre-authentication program is a program for authenticating the aforementioned authentication program. The authentication program and the pre-authentication program are written along a procedure (authentication procedure) for proving that the program to be the subject has not been falsified.

The motherboard 70 is provided with a main CPU 71, a ROM 72, a RAM 73, and a communication interface 82.

The ROM 72 includes a memory device such as a flash memory, and stores a program such as BIOS to be executed by the main CPU 71, and permanent data. When the BIOS is executed by the main CPU 71, processing for initializing predetermined peripheral devices is performed. Further, through the gaming board 50, processing of loading the game program and the gaming system program stored in the memory card 54 is started.

The RAM 73 stores data and programs which are used in operation of the main CPU 71. For example, when the processing of loading the aforementioned game program, gaming system program or authentication program is performed, the RAM 73 can store the program. The RAM 73 is provided with working areas used for operations in execution of these programs. Examples of the areas include: an area that stores counters for the number of games, the amount of bet, the amount of payout, the amount of credit and the like; and an area that stores symbols determined by lottery.

The communication interface 82 is for communicating with the external controller such as a server, through the communication line. Further, the motherboard 70 is connected with a later-described door PCB (Printed Circuit Board) 90 and a main body PCB 110 by respective USBs. The motherboard 70 is also connected with a power unit 81.

When the power is supplied from the power unit 81 to the motherboard 70, the main CPU 71 of the motherboard 70 is activated, and then the power is supplied to the gaming board 50 through the PCI bus so as to activate the CPU 51.

The door PCB 90 and the main body PCB 110 are connected with input devices such as a switch and a sensor, and peripheral devices the operations of which are controlled by the main CPU 71.

The door PCB 70 is connected with a control panel 30, a reverter 91, a coin counter 92C and a cold cathode tube 93.

The control panel 30 includes: a reserve switch 31S, a collect switch 32S, a game rule switch 33S, a 1-bet switch 34S, a 2-bet switch 35S, a 3-bet switch 37S, a gamble switch 45S, and a start switch 46S which respectively corresponds to the above mentioned buttons. Each of the switches outputs a signal to the main CPU 71 upon detection of press of the button corresponding thereto by the player.

The coin counter 92C determines whether or not the material and shape or the like of an input coin is valid, and if it is valid, outputs a signal to the main CPU 71. Invalid coins are discharged from a coin outlet 18.

The reverter 91 operates based on a control signal outputted from the main CPU 71, and distributes valid coins validated by the coin counter 92C into a hopper 113 or a cash box (not shown). That is, coins are distributed into the hopper 113 when the hopper 113 is not filled with coins, while coins are distributed into the cash box when the hopper 113 is filled with coins.

The cold cathode tube 93 functions as a backlight installed on the rear face sides of the upper image display panel 131, and lights up based on a control signal outputted from the main CPU 71.

The main body PCB 110 is connected with the lamp 111, the speaker 112, the hopper 113, a coin detecting unit 1135, a touch panel 69, a bill entry 22, a graphic board 130, index detection circuit 151, position change detection circuit 152, backlight control circuit M10, motor driving circuit 153, the ticket printer 171, the card reader 172, a key switch 173S and the data display 174. Further, the index detection circuit 151, position change detection circuit 152, motor driving circuit 153, and the backlight control circuit M10 are connected to the reel device M1.

The lamp 111 lights up based on a control signal outputted from the main CPU 71. The speaker 112 outputs sounds such as BGM, based on a control signal outputted from the main CPU 71.

The hopper 113 operates based on a control signal outputted from the main CPU 71, and pays out coins of the specified amount of payout from the coin outlet 18. The coin detecting unit 113S outputs a signal to the main CPU 71 upon detection of coins paid out by the hopper 113.

The touch panel 69 specifies the position touched by the player, and outputs a position signal corresponding to the specified position to the main CPU 71. Upon acceptance of a valid bill, the bill entry 22 outputs to the main CPU 71 a signal corresponding to the face amount of the bill.

The graphic board 130 controls display of images performed by the lower image display panel 141, based on a control signal outputted from the main CPU 71. The graphic board 130 is provided with a VDP generating image data, a video RAM temporarily storing the image data generated by the VDP, and the like.

The motor driving circuit 153 has an FPGA (Field Programmable Gate Array) 155 and a driver 154. The motor driving circuit 153 is connected to a stepping motor which rotates the reels 101, 102, 103, 104, 105.

The FPGA 155 is an electronic circuit such as a programmable LSI, and functions as a control circuit of the stepping motor. The driver 154 functions as an amplifying circuit for pulses to be input to the stepping motor.

The index detection circuit 151 detects positions of the rotating reels 101, 102, 103, 104, 105, and is capable of detecting any of the reels 101, 102, 103, 104, 105 stepped out.

The position change detection circuit 152 detects a change in the stop positions of the reels 101, 102, 103, 104, 105 after the reels 101, 102, 103, 104, 105 stop rotating. For example, suppose the symbols 501 having stopped form no winning combinations. If the stop position of any of the reels 101, 102, 103, 104, 105 is illicitly changed from the outside to form a combination of symbols 501 related to a winning, the position change detection circuit 152 detects that change in the stop position. For example, each of the reels 101, 102, 103, 104, 105 is provided with not-shown fins which are attached inside the reel at predetermined intervals, and the position change detection circuit 152 detects a change in the stop position of any of the reels 101, 102, 103, 104, 105 by detecting any of the fins.

The excitation method of the stepping motor is not particularly limited. A 1-2 phase excitation method, 2 phase excitation method are adoptable. It is also possible to adopt a DC motor instead of a stepping motor. When the DC motor is adopted, the main body PCB 110 is connected to a deviation counter, a D/A converter, and a servo amplifier in this order, and the DC motor is connected to the servo amplifier. Further, the rotating position of the DC motor is detected by a rotary encoder, and data of the current rotate position of the DC motor is supplied from the rotary encoder to the deviation counter.

The backlight control circuit M10 is connected the backlight sources M70 of the backlight device M7 so that the drive power is individually supplied to the backlight sources M70. Further, the backlight control circuit M10 is capable of adjusting the amount of light emission from the backlight source M70 to several levels, in response to an instruction from the main CPU 71. Further, the five backlight devices M7 respectively provided to the inner circumferences of the reels 101, 102, 103, 104, 105 are capable of causing the fifteen backlight sources M70 to individually emit light towards the fifteen symbols 501 stopped in the display window 150, under control by the backlight control circuit M10.

Based on a control signal outputted from the main CPU 71, the ticket printer 171 prints on a ticket a barcode representing encoded data of the credit amount stored in the RAM 73, date and time, the identification number of the slot machine 10, and the like, and then outputs the ticket as the ticket 175 with a barcode.

The card reader 172 reads data stored in a card inserted into the card slot 176 and transmits the data to the main CPU 71, or writes data into the card based on a control signal outputted from the main CPU 71.

The key switch 173S is provided in the keypad 173, and outputs a predetermined signal to the main CPU 71 when the keypad 173 has been operated by the player.

The data display 174 displays data read by the card reader 172 and data inputted by the player through the keypad 173, based on a control signal outputted from the main CPU 71.

(Structure of Symbol Combination Table)

Next, with reference to FIGS. 8A and 8B, a symbol combination table 191 is described.

The symbol combination table 191 specifies combinations of drawn symbols 501 relating to winning, the amount of payout, and the occurrence chances of the combinations. On the slot machine 10, the scrolling of symbol array on the video reels 101, 102, 103, 104, 105 is stopped successively, and winning is established when the combination of symbols displayed along a payline L1, L2, L3, L4, or L5 matches one of the combinations of symbols 501 specified by the symbol combination table. According to the combination of symbols 501 resulting in a winning, a benefit such as payout of coins or start of a feature game is offered to the player. It is to be noted that winning is not established (i.e. the game is lost) when the combination of symbols 501 displayed along the payline L1, L2, L3, L4, or L5 does not match any of the combinations of symbols 501 specified by the symbol combination table.

For example, as shown in the symbol combination table of FIG. 8A and FIG. 8B, when five "DOUBLE BAR" symbols 163 are displayed on the payline L1, the amount of payout is determined as to be "90". Further, for example, three "7" symbols 161 are displayed on the payline L4, the amount of payout is determined as to be "200". Based on the determined amount of payout, payout of coins is performed. The payout of coins is performed by actually outputting coins from the coin outlet 18 or adding the determined amount of payout to the credit amount, or issuing a ticket with a barcode.

Further, the symbol "CHANCE CHERRY" symbol 166 is a trigger for a feature game. When the "CHANCE CHERRY" symbol 166 on the outer circumference of the third reel 103 is displayed in the display window 150, a "feature game" is awarded, and the feature game is started from the next game.

Note that, in the feature game, a winning is determined based on the occurrence chance for the feature game shown in FIG. 8A and FIG. 8B. That is, in the feature game, the player is able to play a game with a higher chance of winning than that of the base game.

Next, the following describes an occurrence chance changing table 192, with reference to FIG. 9.

The occurrence chance changing table 192 regulates an occurrence chance of a winning related to "7" symbol 161 according to the number of games continued in the feature game and an occurrence chance of a winning related to the "CHERRY" symbol 165. For example, in the first game in the feature game, any winning related to the "7" symbol 161, i.e., a winning with three "7" symbols 161, a winning with four "7" symbols 161, or a winning with five "7" symbols 161, occurs at the occurrence chance of 1/21.7. For example, in the second game in the feature game, any winning related to the symbol "7" symbol 161, i.e., a winning with three "7" symbols 161, a winning with four "7" symbols 161, or a winning with five "7" symbols 161, occurs at the occurrence chance of 1/18.7. As described, in the feature game, the occurrence chance is set so that a winning related to the "7" symbol 161 and a winning related to the "CHERRY" symbol 165 occur at a higher occurrence chance, as the number of games in the feature game increase.

(Description of Program)

Next, the program to be executed by the slot machine 10 is described.

(Main Control Process)

Figure 10:
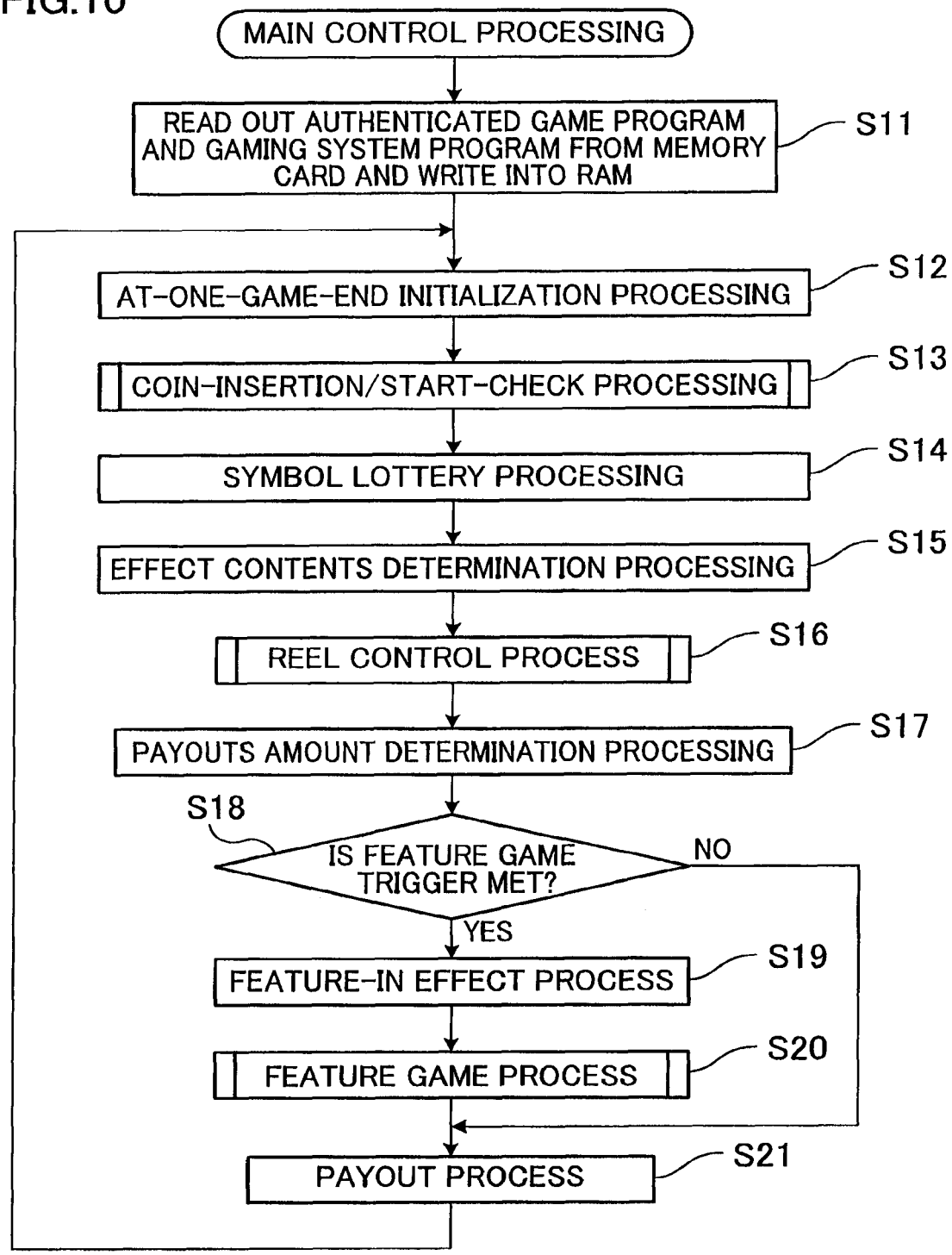
FIG. 10 is a flowchart of a main control processing performed in the slot machine of the embodiment, according to the present invention.

First, with reference to FIG. 10, main control processing is described.

First, when the power is supplied to the slot machine 10, the main CPU 71 reads the authenticated game program and gaming system program from the memory card 54 through the gaming board 50, and writes the programs into the RAM 73 (step 11; hereinafter simply labeled as S11).

Next, the main CPU 71 performs at-one-game-end initialization processing (S12). For example, data that becomes unnecessary after each game in the working areas of the RAM 73, such as the bet amount and the symbols 501 determined by lottery, is cleared.

The main CPU 71 performs coin-insertion/start-check processing which is described later with reference to FIG. 11 (S13). In the processing, input from the BET switch (1-bet switch 34S, 2-bet switch 35S, 3-bet switch 37S) and the start switch 46S is checked.

The main CPU 71 then performs symbol lottery processing (S14). In the processing, to-be stopped symbols are determined based on the random number for symbol determination.

Specifically, the main CPU 71 first samples random numbers for symbol determination. The main CPU 71 then determines to-be stopped symbols for the each of the reels 101, 102, 103, 104, 105 by lottery (S112). The main CPU 71 holds a lottery for each of the reels 101, 102, 103, 104, 105, and determines any one of the 11 symbols as a to-be stopped symbol.

The main CPU 71 then stores the determined to-be stopped symbols for each of the reels 101, 102, 103, 104, 105 into a symbol storage area provided in the RAM 73. Next, the main CPU 71 references the symbol combination table 191 (FIGS. 8A and 8B) and determines a winning combination based on the symbol storage area. The main CPU 71 determines whether or not the combination of symbols 501 to be displayed along a payline L1, L2, L3, L4, or L5 by each of reels 101, 102, 103, 104, and 105 matches any of the combinations of symbols 501 specified by the symbol combination table 191, and determines the winning combination. After the processing has been performed, the symbol lottery processing is completed.

The main CPU 71 performs effect contents determination processing (815). The main CPU 71 extracts a random value for effect, and determines any of the effect contents from the preset plurality of effect contents by lottery. For example, when the effects are assigned to the types of the symbols, respectively, the main CPU 71 refers to the to-be stopped symbols of the reels 101, 102, 103, 104, 105, and randomly determines any effect content out of the effect contents assigned.

Next, the main CPU 71 performs a reel control process which is described later with reference to FIG. 12 (S16). In this process, the rotations of the reels 101, 102, 103, 104, 105 are stopped so that the to-be stopped symbols determined in the symbol lottery processing of S14 are displayed along the paylines L1, L2, L3, L4, L5.

Next, the main CPU 71 performs payout amount determination processing (S17). In the processing, the amount of payout is determined based on the combination of symbols 501 displayed along the payline L1, L2, L3, L4, or L5, and is stored into a payout counter provided in the RAM 73.

The main CPU 71 then determines whether or not the feature game trigger has been established (S18). Specifically, there is determined whether or not the "CHANCE CHERRY" symbol 166 on the outer circumference of the third reel 103 has stopped to be displayed in the display window 150. When the main CPU 71 determines that the feature game trigger has been established (S18: YES), the main CPU 71 performs feature game processing which is described later with reference to FIG. 14 (step S20), after performing a feature-in effect process (S19).

Figure 15:
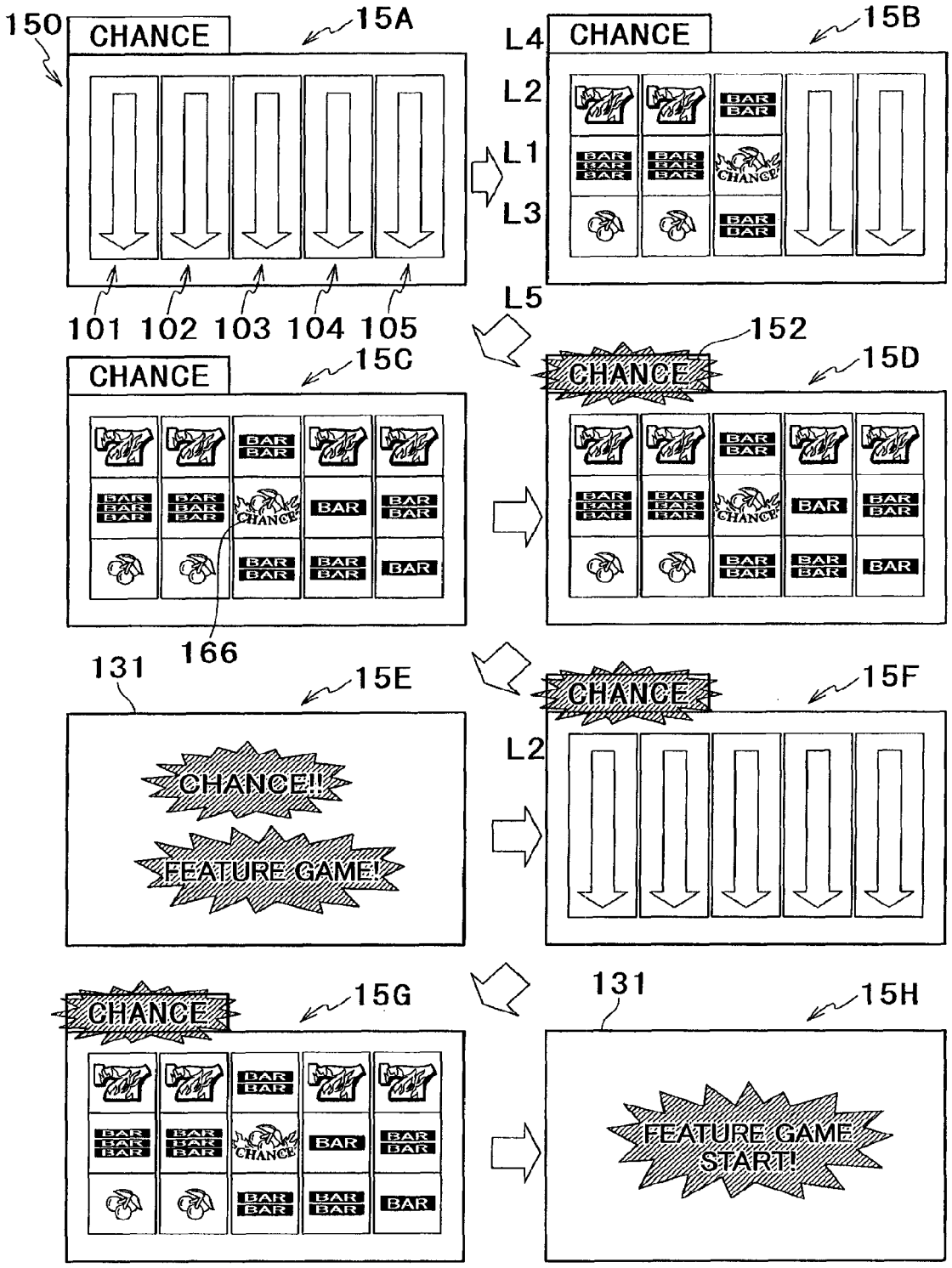
FIG. 15 is a diagram showing the display window screen and an upper image display panel, during a feature-in effect process, in the slot machine of the embodiment, according to the present invention.

The following describes the feature-in effect process (S19) with reference to FIG. 15. First, as shown in the display window screens 15A, 15B, and 15C of FIG. 15, the reels 101, 102, 103, 104, 105 are successively stopped rotating so that the symbols 501 are displayed in the display window 150. Then, there is determined whether or not the "CHANCE CHERRY" symbol 166 has stopped in the display window 150 (S18). When it is determined that the "CHANCE CHERRY" symbol 166 is displayed in the display window 150 thus meeting the feature game trigger, electroluminescent displaying is performed on the electroluminescent display 152 to light up and display text reading "CHANCE" as shown in the display window screen 15D of the FIG. 15.

Next, as in the effect screen 15E of FIG. 15, there is provided an effect that displays on the upper image display panel 131 text reading "CHANCE" and text reading "FEATURE GAME!". This way, the player is notified that the feature game will be run.

Next, as shown in the display window screen 15F of FIG. 15, the reels 101, 102, 103, 104, 105 are rotated a predetermined period (the period is 5 seconds in the present embodiment; however may be changed as needed). Next, as shown in the display window screen 15G of FIG. 15, the reels 101, 102, 103, 104, 105 are stopped at the same time. Then, as shown in the effect screen 15H of FIG. 15, the upper image display panel 131 displays text reading "FEATURE GAME START!". Then, a feature game process (S20) is performed.

Note that, when the reels 101, 102, 103, 104, 105 are rotated for a predetermined period in the display window screen 15F of FIG. 15, the plurality of symbols 501 may be lighted or blinked while being rotated, by using the backlight sources M70 of the backlight devices M7.

After the processing of step S20 or when determining in step S18 that the feature game trigger has not been established (S18: NO), the main CPU 71 performs the payout processing (step S21). The main CPU 71 adds the value stored in the payout counter to a value stored in a credit counter provided in the RAM 73. It is to be noted that operations of the hopper 113 may be controlled based on input from the collect switch 32S, and coins of the number corresponding to the value stored in the payout counter may be output from the coin outlet 18. Further, operations of the ticket printer 171 may be controlled and a ticket with a barcode may be issued on which a value stored in the payout counter is recorded. After the processing has been performed, the processing is shifted to step S12.

(Coin-Input/Start-Checking Process)

Figure 11:
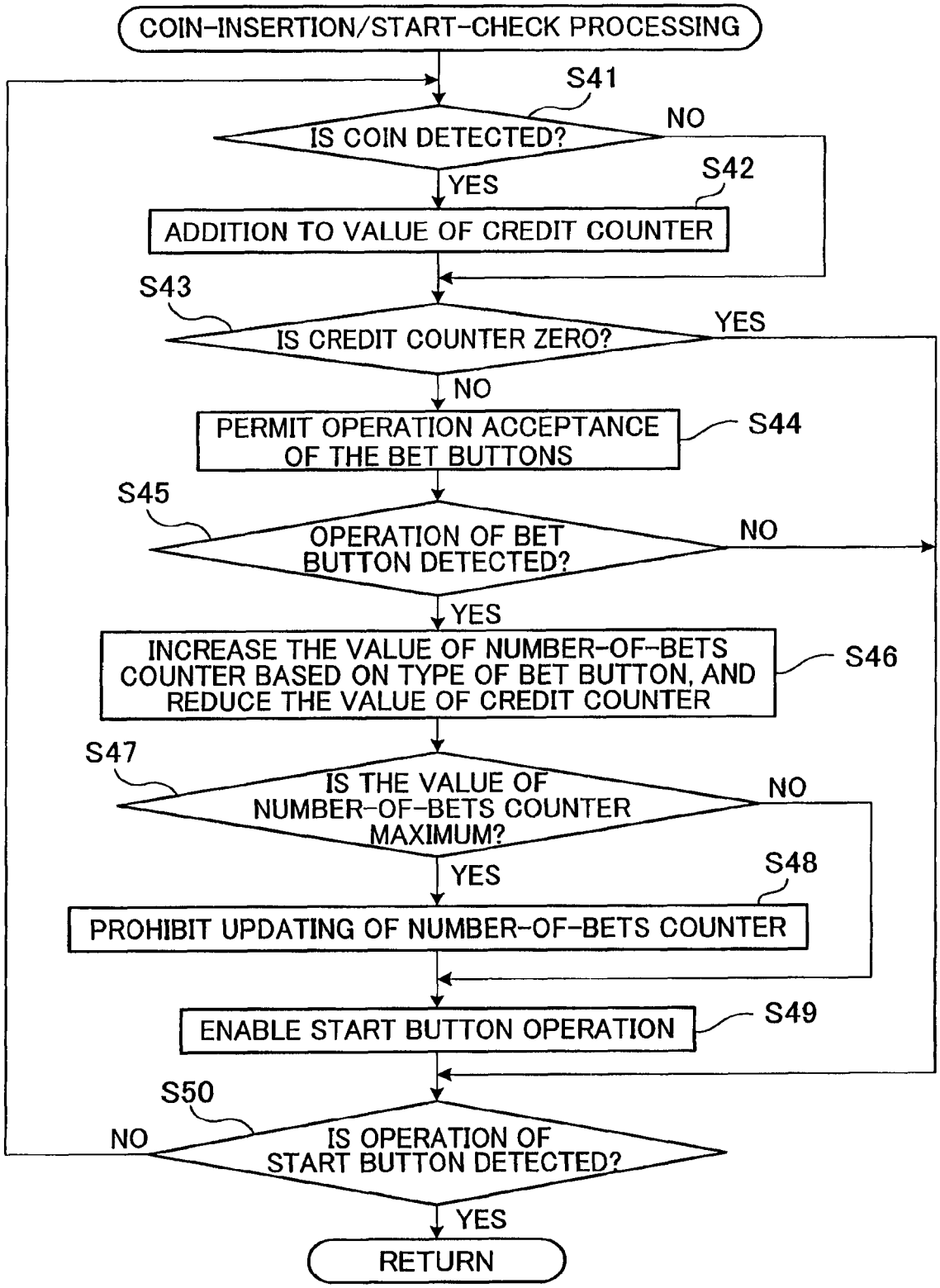
FIG. 11 is a flowchart of a coin-input/start-checking process performed in the slot machine of the embodiment, according to the present invention.

Next, the following describes the coin-input/start-checking process with reference to FIG. 11.

First, the main CPU 71 determines whether or not insertion of a coin has been detected by the coin counter 92C (S41). When determining that the insertion of a coin has been detected (S41: Yes), the main CPU 71 makes an addition to the value stored in the credit counter (step S42). It is to be noted that, in addition to the insertion of a coin, the main CPU 71 may determine whether or not insertion of a bill has been detected by the bill entry 22, and when determining that the insertion of a bill has been detected, the main CPU 71 may add a value according to the bill to the value stored in the credit counter.

After step S42 or when determining in step S41 that the insertion of a coin has not been detected (S41: No), the main CPU 71 determines whether or not the value stored in the credit counter is zero (S43). When the main CPU 71 determines that the value stored in the credit counter is not zero (S43: Yes), the main CPU 71 permits operation acceptance of the BET buttons (1-bet button 34, 2-bet button 35, 3-bet button 37) (step S44).

Next, the main CPU 71 determines whether or not operation of any of the BET buttons (1-bet button 34, 2-bet button 35, 3-bet button 37) has been detected (step S45). When the main CPU 71 determines that the BET switches (1-bet switch 34S, 2-bet switch 35S, 3-bet switch 37S) has detected press of the corresponding one of the BET buttons (1-bet button 34, 2-bet button 35, 3-bet button 37) by the player, the main CPU 71 makes an addition to a value stored in a bet counter provided in the RAM 73 and makes a subtraction from the value stored in the credit counter, based on the type of the BET button (S46).

The main CPU 71 then determines whether or not the value stored in the bet counter is at its maximum (S47). When the main CPU 71 determines that the value stored in the bet counter is at its maximum (S47: Yes), the main CPU prohibits updating of the value stored in the bet counter (S48). After step S48 or when determining in step S47 that the value stored in the bet counter is not at its maximum (S47: No), the main CPU 71 permits operation acceptance of the start button 46 (S49).

After S49 or when determining in S45 that the operation of any of the BET buttons has not been detected, or when determining in step S43 that the value stored in the credit counter is zero, the main CPU 71 determines whether or not operation of the start button 46 has been detected (S50). When the main CPU 71 determines that the operation of the start button 46 has not been detected (S50: No), the processing is shifted to step S41.

When the main CPU 71 determines that the operation of the start button 46 has been detected (S50: Yes), the coin-input/start-checking process is ended.

(Reel Control Process)

Figure 12:
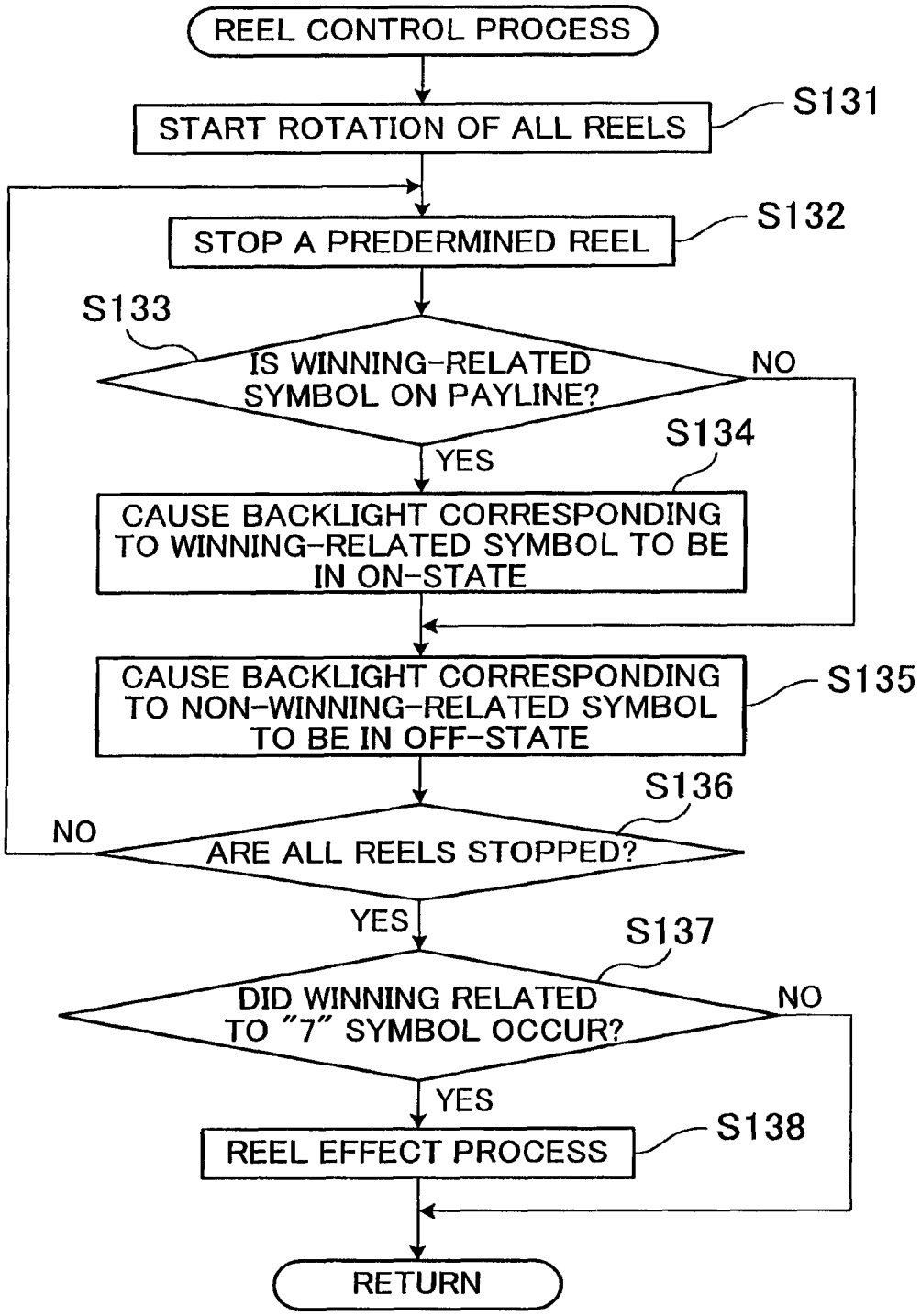
FIG. 12 is a flowchart of a reel control process performed in the slot machine of the embodiment, according to the present invention.
Figure 13:
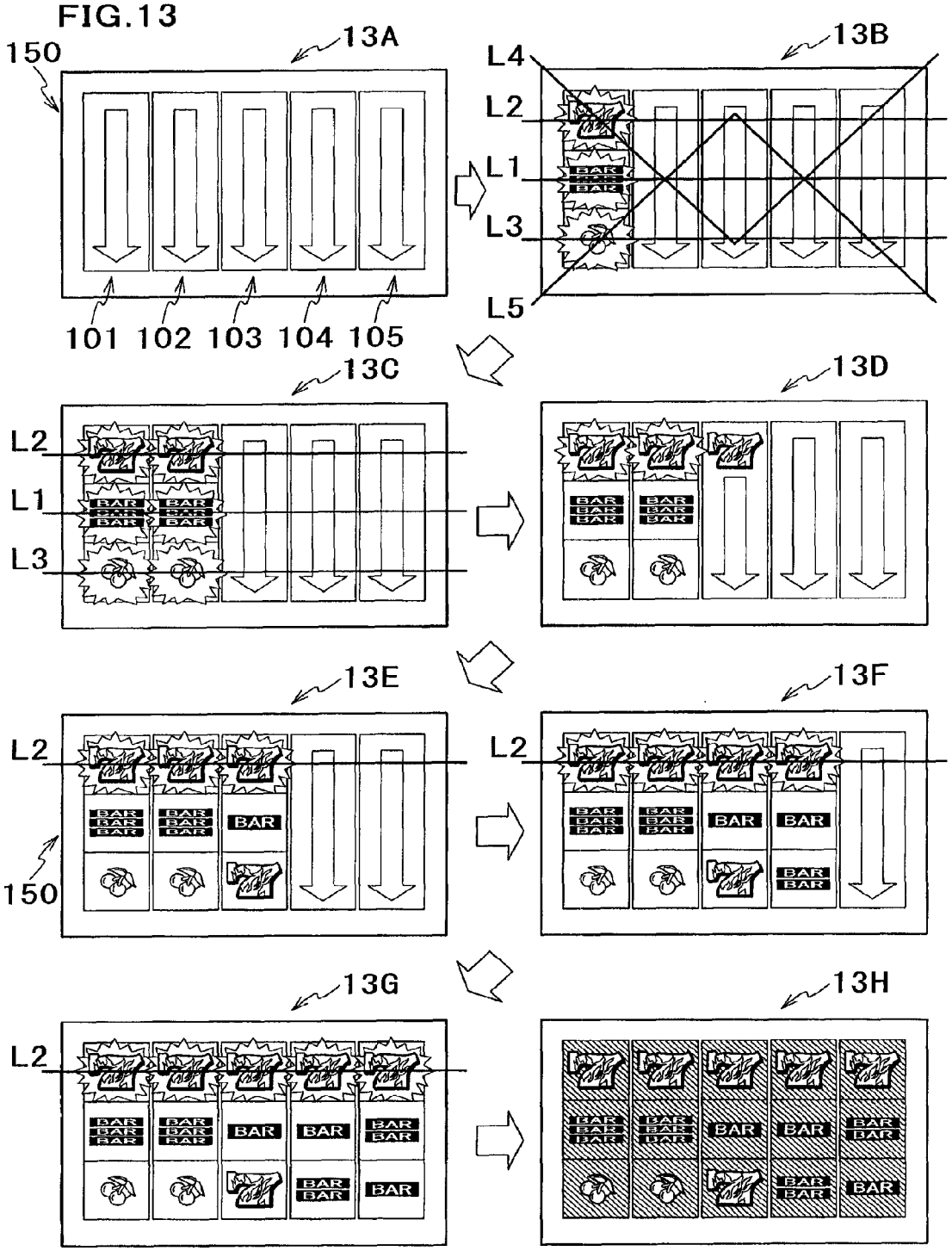
FIG. 13 is a diagram showing a display window screen during a backlight effect in the slot machine of the embodiment, according to the present invention.

Next, the following describes a reel control process, with reference to FIG. 12 and FIG. 13.

First, as shown in the display window screen 13A of FIG. 13, the main CPU 71 controls the stepping motor to start rotating the reels 101, 102, 103, 104, 105 (S131).

Next, as shown in the display window screen 13B of FIG. 13, the main CPU 71 controls the stepping motor to stop rotating the first reel 101 based on the above mentioned symbol storage area (S132). For example, supposing that to-be stopped symbols on the first reel 101 are a "7" symbol 161, a "TRIPLE BAR" symbol 164, and a "CHERRY" symbol 165 from the upper stage of the display window 150, the rotation of the first reel 101 is stop when the "TRIPLE BAR" symbol 164 reaches the payline L1.

Next, the main CPU 71 determines whether or not any of the symbols 501 stopped on the paylines L1, L2, L3, L4, and L5 is a winning-related symbol (S133). Specifically, there is determined whether or not any of the symbols 501 stopped on the paylines L1, L2, L3, L4, and L5 is a symbol that structures a winning combination shown in the symbol combination table 191.

When the main CPU 71 determines that a symbol 501 stopped on any of the paylines L1, L2, L3, L4, and L5 is a winning-related symbol (S133: YES), the main CPU 71 causes the backlight source M70 of the backlight device M7, which corresponds to the winning-related symbol, to be in the on-state as shown in display window screen 13B of FIG. 13 (S134). Specifically, the "7" symbol 161, the "TRIPLE BAR" symbol 164, and the "CHERRY" symbol 165 are turned to or kept in a lighting-state.

After S134 or when the main CPU 71 determines a symbol 501 stopped on the paylines L1, L2, L3, L4, and L5 is a non-winning-related symbol (S133: NO), the main CPU 71 causes the backlight source M70 of the backlight device M7, which corresponds to the non-winning-related symbol, to be in the off-state (S135).

Next the main CPU 71 determines whether or not all the reels 101, 102, 103, 104, 105 have stopped rotating (S136). When the main CPU 71 determines that at least one of the reels 101, 102, 103, 104, 105 is still rotating (S136: NO), the process shifts to S132. At this time, when it is determined that only the first reel 101 has stopped, the main CPU 71 controls the stepping motor and stops the rotation of the second reel 102 based on the symbol storage area, as shown in the display window screen 13C of FIG. 13 (S132). For example, when the to-be stopped symbols on the second reel 102 are a "7" symbol 161, a "TRIPLE BAR" symbol 164, and a "CHERRY" symbol 165 in this order from the upper stage of the display window 150, the rotation of the second reel 102 stops when the "TRIPLE BAR" symbol 164 reaches the payline L1.

Next, similarly to the previous steps, the main CPU 71 determines whether or not any symbol 501 stopped on the paylines L1, L2, L3, L4, and L5 is a winning-related symbol (S133).

When the main CPU 71 determines that a symbol 501 stopped on any of the paylines L1, L2, L3, L4, and L5 is a winning-related symbol (S133: YES), the main CPU 71 causes the backlight source M70 of the backlight device M7, which corresponds to the winning-related symbol, to be in the on-state as shown in display window screen 13C of FIG. 13 (S134). Specifically, the "7" symbol 161 on payline L2, the "TRIPLE BAR" symbol 164 on payline L1, and the "CHERRY" symbol 165 on payline L3 are turned to or kept in a lighting-state.

After S134 or when the main CPU 71 determines a symbol 501 stopped on the paylines L1, L2, L3, L4, and L5 is a non-winning-related symbol (S133: NO), the main CPU 71 causes the backlight source M70 of the backlight device M7, which corresponds to the non-winning-related symbol, to be in the off-state (S135). Note that in the example of FIG. 13, there is no symbol whose lighting is turned to or kept in the off-state, when the second reel 102 is stopped.

Next, the main CPU 71 determines if all of the reels 101, 102, 103, 104, 105 have stopped rotating (S136). When the main CPU 71 determines that at least one of the reels 101, 102, 103, 104, 105 has not yet stopped rotating (S136: NO), the process shifts to S132. At this time, if it is determined that only the first reel 101 and the second reel 102 have stopped, the main CPU 71 controls the stepping motor to stop the rotation of the third reel 103 based on the symbol storage area as shown in display window screen 13D, 13E of FIG. 13 (S132). For example, when the to-be stopped symbols on the third reel 103 are a "7" symbol 161, a "SINGLE BAR" 162, and another "7" symbol 161 from the upper stage of the display window 150, the third reel 103 is stopped rotating when the "SINGLE BAR" 162 reaches the payline L1.

As in the display window screen 13D of FIG. 13, when there are two "7" symbols 161 on the payline L2, i.e., when a winning related to the "7" symbol 161 is likely to be achieved, the rotation of the reel to be stopped next is slow downed. For example, when there are two symbols 161 on the payline L2, the third reel 103 starts rotating slowly. Thus, with an expectation that a winning relating to the "7" symbol 161 may be achieved on any of the paylines L1, L2, L3, L4, and L5, the player is able to enjoy the game.

Next, similarly to the previous steps, the main CPU 71 determines whether or not any symbol 501 stopped on the paylines L1, L2, L3, L4, and L5 is a winning-related symbol (S133).

When the main CPU 71 determines that a symbol 501 stopped on any of the paylines L1, L2, L3, L4, and L5 is a winning-related symbol (S133: YES), the main CPU 71 causes the backlight source M70 of the backlight device M7, which corresponds to the winning-related symbol, to be in the on-state as shown in display window screen 13E of FIG. 13 (S134). Specifically, the "7" symbol 161 on the payline L2 is turned to or kept in a lighting-state.

After S134 or when the main CPU 71 determines a symbol 501 stopped on the paylines L1, L2, L3, L4, and L5 is a non-winning-related symbol (S133: NO), the main CPU 71 causes the backlight source M70 of the backlight device M7, which corresponds to the non-winning-related symbol, to be in the off-state (S135). In the example of FIG. 13, when the third reel 103 stops, lightings of the symbols 501 stopped in the middle and the lower stages of the display window 150 are turned to or kept in the off-state.

Next the main CPU 71 determines whether or not all the reels 101, 102, 103, 104, 105 have stopped rotating (S136). When the main CPU 71 determines that at least one of the reels 101, 102, 103, 104, 105 has not yet stopped rotating (S136: NO), the process shifts to S132. At this time, when it is determined that the first reel 101, the second reel 102, and the third reel 103 have stopped, the main CPU 71 controls the stepping motor and stops the rotation of the fourth reel 104 based on the symbol storage area, as shown in the display window screen 13F of FIG. 13 (S132). For example, when the to-be stopped symbols on the fourth reel 104 are a "7" symbol 161, a "DOUBLE BAR" symbol 163, and a "SINGLE BAR" 163 from the upper stage of the display window 150, the fourth reel 104 is stopped rotating when the "SINGLE BAR" 162 reaches the payline L1.

Next, similarly to the previous steps, the main CPU 71 determines whether or not any symbol 501 stopped on the paylines L1, L2, L3, L4, and L5 is a winning-related symbol (S133).

When the main CPU 71 determines that a symbol 501 stopped on any of the paylines L1, L2, L3, L4, and L5 is a winning-related symbol (S133: YES), the main CPU 71 causes the backlight source M70 of the backlight device M7, which corresponds to the winning-related symbol, to be in the on-state as shown in display window screen 13F of FIG. 13 (S134). Specifically, the four "7" symbols 161 on the payline L2 are turned to or kept in a lighting-state.

After S134 or when the main CPU 71 determines a symbol 501 stopped on the paylines L1, L2, L3, L4, and L5 is a non-winning-related symbol (S133: NO), the main CPU 71 causes the backlight source M70 of the backlight device M7, which corresponds to the non-winning-related symbol, to be in the off-state (S135). In the example of FIG. 13, when the fourth reel 104 stops, lightings of the symbols 501 stopped in the middle and the lower stages of the display window 150 are turned to or kept in the off-state.

Next the main CPU 71 determines whether or not all the reels 101, 102, 103, 104, 105 have stopped rotating (S136). When the main CPU 71 determines that at least one of the reels 101, 102, 103, 104, 105 has not yet stopped rotating (S136: NO), the process shifts to S132. At this time, when it is determined that the first reel 101, the second reel 102, the third reel 103, and the fourth reel 104 have stopped, the main CPU 71 controls the stepping motor and stops the rotation of the fifth reel 105 based on the symbol storage area, as shown in the display window screen 13G of FIG. 13 (S132). For example, when the to-be stopped symbols on the fifth reel 105 are a "7" symbol 161, a "DOUBLE BAR" 163, and a "SINGLE BAR" symbol 162 in this order from the upper stage of the display window 150, the rotation of the fifth reel 105 stops when the "DOUBLE BAR" 163 reaches the payline L1.

Next, similarly to the previous steps, the main CPU 71 determines whether or not any symbol 501 stopped on the paylines L1, L2, L3, L4, and L5 is a winning-related symbol (S133).

When the main CPU 71 determines that a symbol 501 stopped on any of the paylines L1, L2, L3, L4, and L5 is a winning-related symbol (S133: YES), the main CPU 71 causes the backlight source M70 of the backlight device M7, which corresponds to the winning-related symbol, to be in the on-state as shown in display window screen 13G of FIG. 13 (S134). Specifically, the five "7" symbols 161 on the payline L2 are turned to or kept in a lighting-state.

After S134 or when the main CPU 71 determines a symbol 501 stopped on the paylines L1, L2, L3, L4, and L5 is a non-winning-related symbol (S133: NO), the main CPU 71 causes the backlight source M70 of the backlight device M7, which corresponds to the non-winning-related symbol, to be in the off-state (S135). In the example of FIG. 13, when the fifth reel 105 stops, lightings of the symbols 501 stopped in the middle and the lower stages of the display window 150 are turned to or kept in the off-state.

Next, when the main CPU 71 determines that all the reels 101, 102, 103, 104, 105 have stopped rotating (S136: YES), the main CPU 71 determines whether or not a winning related to the "7" symbol 161 is achieved (S137). The winning related to the symbol "7" symbol 161 means a winning achieved by three "7" symbols 161, four "7" symbols 161, or five "7" symbols 161 (see FIG. 8A and FIG. 8B).

When the main CPU 71 determines that a winning related to the symbol "7" symbol 161 is achieved (S137: YES), the main CPU 71 performs a reel effect process (S138).

In the reel effect process, a large plosive sound is output from the speaker 112. Further, red light is emitted from the backlight sources M70 of the backlight devices M7 corresponding to the "7" symbols 161 stopped in the display window 150. This provides an effect that makes each of the "7" symbols 161 look like as if it is flaming up. Then, red light is emitted from all the backlight sources M70 of the backlight devices M7 corresponding to the symbols 501 stopped in the display window 150, respectively. This provides an effect that makes the entire reels 101, 102, 103, 104, 105 red, as shown in display window screen 13H of FIG. 13.

After S138 or when the main CPU 71 determines that no winning related to the symbol "7" symbol 161 is achieved (S137: NO), the reel control process is ended.

Note that the above embodiment deals with a case where, when the main CPU 71 determines that a symbol 501 stopped on any of the paylines L1, L2, L3, L4, and L5 is a winning-related symbol (S133: YES), the main CPU 71 causes the backlight source M70 of the backlight device M7, which corresponds to the winning-related symbol, to be in the on-state (S134). However, the main CPU 71 may cause the backlight source M70 of the backlight device M7 to be in a blinking-state. Further, the symbol 501 may be lighted with various colors.

(Feature Game Process)

Figure 14:
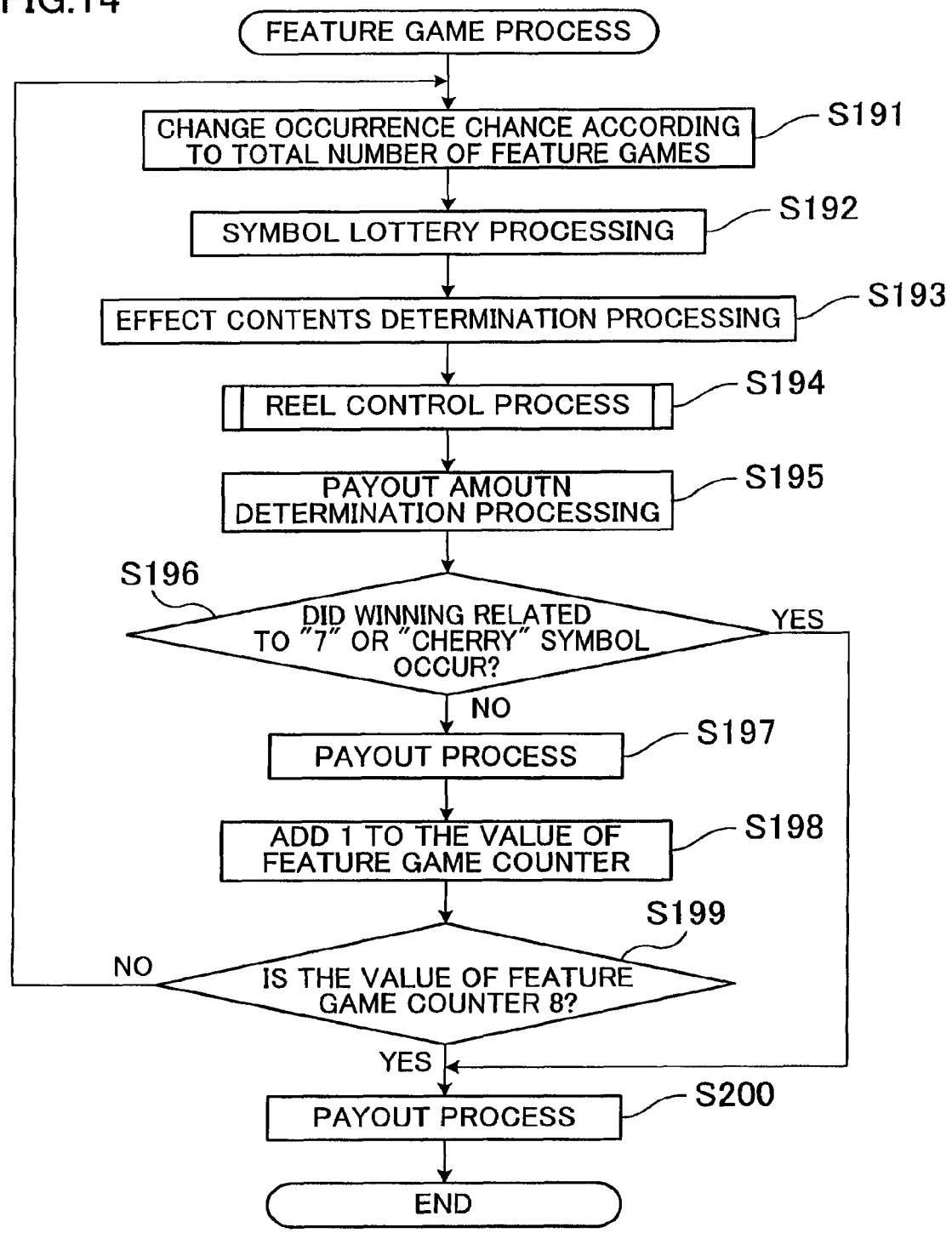
FIG. 14 is a flowchart of a feature game process of the slot machine of the embodiment, according to the present invention.

Next, the following describes a feature game process with reference to FIG. 14.

First, the main CPU 71 changes the occurrence chance according to the total number of feature games (S191). Specifically, with reference to the occurrence chance changing table 192 shown in FIG. 9, the main CPU 71 sets the respective occurrence chances of a winning related to the "CHERRY" symbol 165 and a winning related to the "7" symbol 161, for the value stored in the feature game counter. Immediately after a shift to the feature game, the value of the feature game counter is "1" and the feature game is handled as the "first game". In the "first game" a winning related to the "7" symbol 161 occurs at the probability of 1/21.7

Next, the main CPU 71 performs a symbol lottery processing explained in S14 (S192). Next, the main CPU 71 performs an effect contents determination processing, as is done in S15 (S193). Next, the main CPU 71 performs a reel control process described with reference to FIG. 12 (S194). Next, the main CPU 71 performs the payout amount determination processing explained in relation to S17 (S195).

Next, the main CPU 71 determines whether or not a winning related to the "7" symbol 161 or a winning related to the "CHERRY" symbol 165 has occurred (S196). The winning related to the "CHERRY" symbol 165 is a winning with five "CHERRY" symbols 165, a winning with four "CHERRY" symbols 165, a winning with three "CHERRY" symbols 165, a winning with two "CHERRY" symbols 165, or a winning with a single "CHERRY" symbol 165 (see FIG. 8A and FIG. 8B).

When the main CPU 71 determines that no winning related to the "7" symbol 161 or a winning related to the "CHERRY" symbol 165 has occurred (S196: NO), the main CPU performs the payout process (S197). In the payout process, the main CPU 71 adds to the value of the feature game payout counter the value stored in the payout counter in the payout amount determination processing of S195. The feature game payout counter is a counter for managing the total payout resulting in the feature game.

Next, the main CPU 71 adds 1 to the value of the feature game counter (S198). Next, the main CPU 71 determines whether the value of the feature game counter is 8 (S199). When the main CPU 71 determines that the value of the feature game counter is not 8 (S199: NO), the process shifts to S191. On the other hand, when the main CPU 71 determines that the value of the feature game counter is 8 (S199: YES), or when the main CPU 71 determines in S196 that a winning related to the "7" symbol 161 or a winning related to the "CHERRY" symbol 165 has occurred (S196: YES), the main CPU 71 adds the value of the feature game payout counter to the value stored in the credit counter provided in the RAM 73, in the payout process (S200). That is, the total amount of payout resulting from the feature game is to be awarded. Note that the awarding of the payout may be in the form of outputting coins from the coin outlet 18, or in the form of issuing a ticket having a barcode. The feature game process is then ended.

In the above structure, the reels 101, 102, 103, 104, 105 are stopped rotating successively. Each time one or more reels stop rotating, a backlight source M70 of the backlight device M7, which corresponds to a winning-related symbol 501 on any of the paylines L1, L2, L3, L4, and L5 displayed to the outside through the display window 150, is turned to or kept in the on-state and a backlight source M70 of the backlight device M7 corresponding to a non-winning-related symbol 501, is turned to or kept in the off-state.

Thus, every time any of the reels 101, 102, 103, 104, 105 stops rotating, a symbol 501 likely to result in a prize, which is on any of the paylines L1, L2, L3, L4, and L5, is turned to or kept in a lighting-state by the backlight source M70 of the backlight device M7. This enables the player to promptly recognize and focus on a symbol 501 likely to result in a prize, and enables the player to enjoy the game, wishing for another winning-related symbol 501 to stop.

Further, with the structure, it is possible to cause only the backlight source M70 of the backlight device M7, which corresponds to a winning-related symbol 501, to be in the blinking-state. Therefore, the player is able to more promptly recognize and focus on only the symbol 501 likely to result in a prize.

Further, in the structure, an effect video to notify that a feature game will be run is displayed on the upper image display panel 131, when a combination of symbols 501 causing awarding of a feature game is formed by the symbols 501 rearranged in the display window 150 when the reels 101, 102, 103, 104, 105 are stopped (see the effect screen 15E of FIG. 15). After that, the reels 101, 102, 103, 104, 105 are rotated for five seconds, and the feature game is run (see the effect screen 15H of FIG. 15) thereafter. That is, an effect of rotating the reels 101, 102, 103, 104, 105 for five seconds is inserted between the effect video to notify that the feature game will be run and actual running of the feature game.

This provides mentally advantageous effect by providing an extra time for the player to calm down after being excited by the awarding of the feature game. Further, this rotation of the reels 101, 102, 103, 104, 105 lasting five seconds enables the player to calm down and induces the player to mentally prepare for the feature game.

Further, in the structure, a plurality of symbols 501 are turned to or kept in a lighting-state by the backlight sources M70 of the backlight device M7, while rotating the reels 101, 102, 103, 104, 105 for five seconds. This causes the player to be excited for the feature game to be run.

The above embodiment thus described solely serves as a specific example of the present invention, and the present invention is not limited to such an example. Specific structures of various means and the like may be suitably designed or modified. Further, the effects of the present invention described in the above embodiment are not more than examples of most preferable effects achievable by the present invention. The effects of the present invention are not limited to those described in the embodiments described above.

For example, the above embodiment deals with a case where, there is determined whether a symbol 501 having stopped on any of the paylines L1, L2, L3, L4, and L5 is a winning-related symbol, for the purpose of determining whether a winning will occur. This however could be done without involving a payline, and using a scatter symbol instead. In a game using a scatter symbol, a winning (awarding of a payout, a feature game, or the like) is determined by determining whether or not a winning-related symbol is included in a matrix of arrangement areas structured by symbols of five rows and 3 columns displayed in the display window 150, when the reels 101, 102, 103, 104, 105 are stopped. For example, in a game adopting the scatter symbol, a prize is awarded when a predetermined number or more of the scatter symbols (e.g. five scatter symbols) are displayed in the display window 150 (in any of the 15 arrangement areas). That is, a prize is awarded as long as a predetermined number or more of the scatter symbols are displayed in the display window 150, and the respective positions and alignment of the scatter symbols can be any given positions and alignment.

In the above structure, the reels 101, 102, 103, 104, 105 are stopped rotating successively. Each time at least one of the reels stops rotating, a backlight source M70 of the backlight device M7, which corresponds to a winning-related symbol 501 displayed to the outside through the display window 150, is turned to or kept in the on-state while a backlight source M70 of the backlight device M7 corresponding to a non-winning-related symbol 501 is turned to or kept in the off-state.

Thus, every time any of the reels 101, 102, 103, 104, 105 stops rotating, only a symbol 501 likely to result in a prize is turned to or kept in a lighting-state by the backlight source M70 of the backlight device M7. This enables the player to promptly recognize and focus on a symbol 501 likely to result in a prize, and enables the player to enjoy the game, wishing for another one of such a symbol 501 to stop.

Further, the detailed description above is mainly focused on characteristics of the present invention to fore the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the present invention described in the present specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes carried out in the steps or blocks, these processes are essentially executed by various devices. Further, the other structures necessary for the steps or blocks are obvious from the above descriptions.

What is claimed is:

1. A gaming machine, comprising:

a plurality of reels each having a plurality of symbols on its outer circumference;

backlights which individually lights the plurality of symbols;

a display window which displays the symbols to the outside; and a controller programmed to run a game in which the plurality of reels are individually driven and rotated to rearrange the symbols, and a prize is awarded when a predetermined winning combination is formed by the symbols displayed on the display window, wherein the controller is further programmed to execute the processes of (a1) driving and rotating the plurality of reels;

(a2) stopping the rotation of one of the reels;

(a3) when the rotation of the one of the reels is stopped in (a2), determining whether each of the symbols of a reel having already been stopped, which are rearranged in the display window, constitutes a part of the winning combination;

(a4) after the determination in (a3), turning on a backlight of a symbol on one of the reels determined to constitute the part of the winning combination, whereas keeping a backlight of a symbol on one of the reels determined as not to constitute the part of the winning combination to be turned off;

(a5) repeatedly executing (a2) to (a4) until all of the reels stop the rotation, wherein:

the controller awards a prize when the symbols rearranged on at least one payline of one of the reels constitutes the predetermined winning combination, and in (a3), determining, for each payline, whether each of the symbols on one of the reels having already been stopped, which are rearranged in the display window, constitutes a part of the winning combination.

2. The gaming machine according to claim 1, wherein, in (a3), the controller causes the backlight of the symbol of one of the reels constituting the part of the winning combination to be in a blinking-state.

* * * * *